US012428797B2

(12) United States Patent
Niroumand

(10) Patent No.: US 12,428,797 B2
(45) **Date of Patent: *Sep. 30, 2025**

(54) AGGREGATE PIERS REINFORCEMENT AGAINST AXIAL LOADS

(71) Applicant: Bahman Niroumand, Boushehr (IR)

(72) Inventor: Bahman Niroumand, Boushehr (IR)

( * ) Notice: Subject to any disclaimer, the term of this patent is extended or adjusted under 35 U.S.C. 154(b) by 603 days.

This patent is subject to a terminal disclaimer.

(21) Appl. No.: 17/838,960

(22) Filed: Jun. 13, 2022

(65) Prior Publication Data

US 2022/0307218 A1 Sep. 29, 2022

Related U.S. Application Data

(63) Continuation-in-part of application No. 17/134,996, filed on Dec. 28, 2020, now Pat. No. 11,359,344.

(60) Provisional application No. 63/276,564, filed on Nov. 6, 2021, provisional application No. 62/954,414, filed on Dec. 28, 2019.

(51) Int. Cl.
*E02D 5/52* (2006.01)

(52) U.S. Cl.
CPC ..... *E02D 5/526* (2013.01); *E02D 2200/1678* (2013.01); *E02D 2200/1685* (2013.01); *E02D 2200/1692* (2013.01); *E02D 2250/003* (2013.01); *E02D 2600/40* (2013.01)

(58) Field of Classification Search
CPC .... E02D 2200/1678; E02D 2200/1685; E02D 2200/1692; E02D 2250/003; E02D 2600/40; E02D 5/526
See application file for complete search history.

(56) References Cited

U.S. PATENT DOCUMENTS

| | | | | | |
|---|---|---|---|---|---|
| 844,294 | A * | 2/1907 | Winslow | E02D 5/80 52/155 |
| 2009/0151272 | A1* | 6/2009 | Hashim | E02D 5/80 52/155 |

FOREIGN PATENT DOCUMENTS

| | | | | | |
|---|---|---|---|---|---|
| CN | 105464067 | A * | 4/2016 | E02D 1/04 |
| CN | 105951823 | A * | 9/2016 | E02D 31/12 |
| CN | 106567384 | A * | 4/2017 | |
| CN | 108487685 | A * | 9/2018 | |
| CN | 112761164 | A * | 5/2021 | E02D 15/04 |
| GB | 2582271 | A * | 9/2020 | E02D 27/42 |
| KR | 20110018160 | A * | 2/2011 | |

* cited by examiner

*Primary Examiner* — Kyle Armstrong

(57) ABSTRACT

A method for reinforcing an aggregate pier. The method includes inserting a conical-head pipe into the aggregate pier, injecting grout into the aggregate pier by injecting the grout into the inner chamber of the hollow rod, driving the conical-head pipe into a soil under the aggregate pier by driving a secondary pipe into the aggregate pier and pushing the conical-head pipe toward the soil under the aggregate pier by utilizing the secondary pipe, filling the secondary pipe with grout, and inserting a reinforcement bar into the secondary pipe and the hollow rod. This method reinforces an aggregate pier against excess tensional and compressional loads of a concrete foundation.

11 Claims, 24 Drawing Sheets

102

624

900

AGGREGATE PIERS REINFORCEMENT AGAINST AXIAL LOADS

CROSS-REFERENCE TO RELATED APPLICATION

This application is a continuation-in-part of U.S. patent application Ser. No. 17/134,996, filed Dec. 28, 2020, and entitled "BARBED MICROPILES FOR SOIL REINFORCEMENT" which takes priority from U.S. Provisional Patent Application Ser. No. 62/954,414, filed on Dec. 28, 2019, and entitled "SOIL REINFORCEMENT BY BARBED MICROPILES" and U.S. Provisional Patent Application Ser. No. 63/276,564 filed on Nov. 6, 2021, and entitled "THE PROCESS OF REINFORCING AGGREGATE PIERS AGAINST AXIAL LOADS" which are all incorporated herein by reference in their entirety.

TECHNICAL FIELD

The present disclosure generally relates to civil and geotechnical engineering, and particularly relates to soil reinforcement for construction purposes. The present disclosure more particularly relates to a method for aggregate piers reinforcement, specifically against axial loads, by utilizing micropiles.

BACKGROUND

A pile is a relatively heavy column of timber, concrete, or steel that may extend into the earth and may serve as a foundation or a support for a structure such as a building or a bridge. Piles may be divided into two general categories: displacement piles and replacement piles. Displacement piles are members that may be driven or vibrated into the ground, and to thereby, may displace a surrounding soil laterally during installation. Replacement piles may be placed or constructed within a previously drilled hole, and to thereby, may replace an excavated ground that is formed by the drilled hole.

A micropile may be a small-diameter (typically less than 300 millimeters) replacement or displacement pile. Micropiles may be used mainly for foundation support of a structure to resist static and seismic loading conditions. Over the last several years, micropiles have become popular for use in commercial buildings and transportation structures. Micropiles may also be used as in-situ reinforcements for slope and excavation stability. Micropiles may be able to withstand axial as well as lateral loads and may be considered as a substitute for conventional piles or as one component in a composite soil/pile mass, depending on the design concept employed. Micropiles may be installed by methods that may cause minimal disturbance to structure, soil, and the environment. The small size of machineries required for installing micropiles may permit installation of micropiles in locations having limited access and low head room. This advantage may permit the micropiles to be installed within existing structures.

Installing and implementing a micropile may be done through a standard method which may include six following steps: (1) excavation or installation of a casing with a rod, (2) continuing the excavation to reach a final depth, (3) removing the rod, (4) placing rebars (short for reinforcing bars) and injecting a first round of grout using a tremie pipe, (5) removing a casing partially or completely and injecting a second round of grout, and (6) complementing the micropile.

Utilizing conventional micropiles and methods of installing and implementing them may be associated with some drawbacks. For example, the aforementioned method for installing and implementing a micropile may be time consuming and expensive. Furthermore, conventional micropiles may not be able to reinforce a soil appropriately. There is, therefore, a need for micropiles that are able to reinforce a soil appropriately and also there is a need for a method of installing and implementing a micropile that is not expensive and time consuming.

Furthermore, one of the challenges of using aggregate piers for soil reinforcement may be their inability to tolerate uplift loads applied from buildings and structures. Therefore, there is also a need for systems and methods that can reinforce aggregate piers so that they may be able to withstand uplift loads which may be applied by a surface foundation due to different loads.

SUMMARY

This summary is intended to provide an overview of the subject matter of the present disclosure, and is not intended to identify essential elements or key elements of the subject matter, nor is it intended to be used to determine the scope of the claimed implementations. The proper scope of the present disclosure may be ascertained from the claims set forth below in view of the detailed description below and the drawings.

According to one or more exemplary embodiments of the present disclosure, a barbed micropile for soil reinforcement at a target location is disclosed. In an exemplary embodiment, the barbed micropile may include a conical-head pipe configured to be inserted into a ground at the target location. In an exemplary embodiment, the conical-head pipe may include a hollow rod, a conical head, and a first plurality of T-shaped elements. In an exemplary embodiment, the hollow rod may include an inner chamber. In an exemplary embodiment, the inner chamber of the hollow rod may be configured to contain grout.

In an exemplary embodiment, the conical head may be attached to a bottom end of the hollow rod. In an exemplary embodiment, the conical head may include a sharp tip. In an exemplary embodiment, the conical head may be configured to facilitate penetration of the conical-head pipe into the ground. In an exemplary embodiment, the first plurality of T-shaped elements may be mounted around an outer surface of the hollow rod.

In an exemplary embodiment, the first plurality of T-shaped elements may be configured to facilitate penetration of the conical-head pipe into the ground. In an exemplary embodiment, each respective T-shaped element of the first plurality of T-shaped elements may include a respective rectangular-shaped plate and a respective triangular-shaped plate. In an exemplary embodiment, the respective rectangular-shaped plate may include a respective rectangular face.

In an exemplary embodiment, the respective triangular-shaped plate may include a first edge and a second edge. In an exemplary embodiment, the triangular-shaped plate may be attached at the first edge of the triangular-shaped plate to the rectangular face of the rectangular-shaped plate. In an exemplary embodiment, the triangular-shaped plate may be attached to the outer surface of the hollow rod at the second edge of the triangular-shaped plate.

In an exemplary embodiment, the first plurality of T-shaped elements may include a first T-shaped element and a second T-shaped element in front of each other, a third T-shaped element and a fourth T-shaped element in front of each other, and a fifth T-shaped element and a sixth T-shaped element in front of each other.

In an exemplary embodiment, the first T-shaped element and the second T-shaped element may be attached to opposite sides of the hollow rod. In an exemplary embodiment, the first T-shaped element and the second T-shaped element may be attached to opposite sides of the hollow rod. In an exemplary embodiment, the fifth T-shaped element and the sixth T-shaped element may be attached to opposite sides of the hollow rod.

In an exemplary embodiment, the conical-head pipe may further include a thorough injection hole on the outer surface of the hollow rod. In an exemplary embodiment, the thorough injection hole may be configured to allow grout discharge from the inner chamber of the hollow rod.

In an exemplary embodiment, the barbed micropile may further include a plurality of pipes comprising a first pipe. In an exemplary embodiment, a bottom end of the first pipe may be attached to a top end of the conical-head pipe. In an exemplary embodiment, each pair of two successive pipes from the plurality of pipes may include a second pipe and a third pipe. In an exemplary embodiment, a bottom end of the third pipe may be attached to a top end of the second pipe.

In an exemplary embodiment, each pipe from the plurality of pipes comprising a respective plurality of T-shaped elements, each respective plurality of T-shaped elements comprising a respective first T-shaped element, a respective second T-shaped element, a respective third T-shaped element, and a respective fourth T-shaped element, the respective first T-shaped element and the respective second T-shaped element being in front of each other, and the respective third T-shaped element and the respective fourth T-shaped element being in front of each other.

In an exemplary embodiment, the conical-head pipe may further include a cylindrical elastic casing. In an exemplary embodiment, the cylindrical elastic casing may be mounted onto the hollow rod and at an opening of the thorough injection hole. In an exemplary embodiment, the cylindrical elastic casing may cover the thorough injection hole.

In an exemplary embodiment, the cylindrical elastic casing configured to allow grout discharge from the inner chamber of the hollow rod through the thorough injection hole and prevent grout penetration into the inner chamber of the hollow rod through the thorough injection hole. In an exemplary embodiment, an inner diameter of cylindrical elastic casing corresponds to an outer diameter of the hollow rod.

According to one or more exemplary embodiments of the present disclosure, a method for soil reinforcement at a target location is disclosed. In an exemplary embodiment, the method may include generating a cavity at the target location, filling the cavity with grout, generating a well at the target location by inserting a barbed micropile into the ground at the target location by driving a conical-head pipe of the barbed micropile into the ground at a bottom of the cavity, filling a space between the barbed micropile and the well's wall with grout by flowing the grout from the cavity into the space between the barbed micropile and the well's wall, and filling an inner chamber of the hollow rod by injecting grout into the barbed micropile.

In an exemplary embodiment, the method may further include discharging grout from the inner chamber of the hollow rod into the space between the barbed micropile and the well's wall by providing a thorough injection hole on the outer surface of the hollow rod. In an exemplary embodiment, the method may further include preventing grout penetration from the space between the barbed micropile and the well's wall into the inner chamber of the hollow rod by covering the thorough injection hole utilizing a cylindrical elastic casing.

In an exemplary embodiment, covering the thorough injection hole utilizing a cylindrical elastic casing may include mounting the cylindrical elastic casing onto the hollow rod and at an opening of the thorough injection hole. In an exemplary embodiment, inserting the conical-head pipe into the ground at the target location may include driving the conical head of the conical-head pipe into the ground by utilizing a mechanical hammer.

In an exemplary embodiment, the method may further include installing a plurality of pipes onto the conical-head pipe through attaching a bottom end of a first pipe of the plurality of pipes to a top end of the conical-head pipe and attaching a bottom end of a third pipe of each pair of two successive pipes from the plurality of pipes to a top end of a second pipe of the each pair of two successive pipes.

The present disclosure also describes an exemplary method for reinforcing an aggregate pier. In an exemplary embodiment, the method may include inserting a conical-head pipe into the aggregate pier. In an exemplary embodiment, the conical-head pipe may include a hollow rod with an inner chamber and a thorough injection hole. In an exemplary embodiment, an exemplary method may further include injecting grout into the aggregate pier by injecting the grout into the inner chamber of the hollow rod and inserting a reinforcement bar into the hollow rod.

In an exemplary embodiment, an exemplary method may further include driving the conical-head pipe into a soil under the aggregate pier by driving a secondary pipe into the aggregate pier and pushing the conical-head pipe toward the soil under the aggregate pier by utilizing the secondary pipe. In an exemplary embodiment, an exemplary method may further include filling the secondary pipe with grout. In an exemplary embodiment, inserting the reinforcement bar into the hollow rod may include inserting the reinforcement bar into the secondary pipe and the hollow rod.

BRIEF DESCRIPTION OF THE DRAWINGS

The drawing figures depict one or more implementations in accord with the present teachings, by way of example only, not by way of limitation. In the figures, like reference numerals refer to the same or similar elements.

DETAILED DESCRIPTION

In the following detailed description, numerous specific details are set forth by way of examples in order to provide a thorough understanding of the relevant teachings. However, it should be apparent that the present teachings may be practiced without such details. In other instances, well known methods, procedures, components, and/or circuitry have been described at a relatively high-level, without detail, in order to avoid unnecessarily obscuring aspects of the present teachings.

The following detailed description is presented to enable a person skilled in the art to make and use the methods and devices disclosed in exemplary embodiments of the present disclosure. For purposes of explanation, specific nomenclature is set forth to provide a thorough understanding of the present disclosure. However, it will be apparent to one skilled in the art that these specific details are not required to practice the disclosed exemplary embodiments. Descriptions of specific exemplary embodiments are provided only as representative examples. Various modifications to the exemplary implementations will be readily apparent to one skilled in the art, and the general principles defined herein may be applied to other implementations and applications without departing from the scope of the present disclosure. The present disclosure is not intended to be limited to the implementations shown, but is to be accorded the widest possible scope consistent with the principles and features disclosed herein.

Herein is disclosed a barbed micropile for soil reinforcement. An exemplary barbed micropile includes a conical-head pipe and a plurality of pipes. The conical-head pipe has a conical head that helps conical-head pipe to be inserted into the ground and penetrate into soil more easily. The conical head-pipe and the plurality of pipes includes a plurality of T-shaped elements on their outer surfaces. The plurality of T-shaped elements on the outer surface of the conical head-pipe and the plurality of pipes help the conical head-pipe and the plurality of pipes to be inserted into the ground and penetrate into soil more easily. Each of the conical head-pipe and the plurality of pipes includes a thorough injection hole on its outer surface. After that the conical head-pipe and the plurality of pipes are inserted into the ground and a well is formed in the ground an amount of grout is pumped into the conical head-pipe and the plurality of pipes. The pumped grout is discharged into the well through the thorough injection holes on the outer surfaces of the conical head-pipe and the plurality of pipes.

Figure 1A:
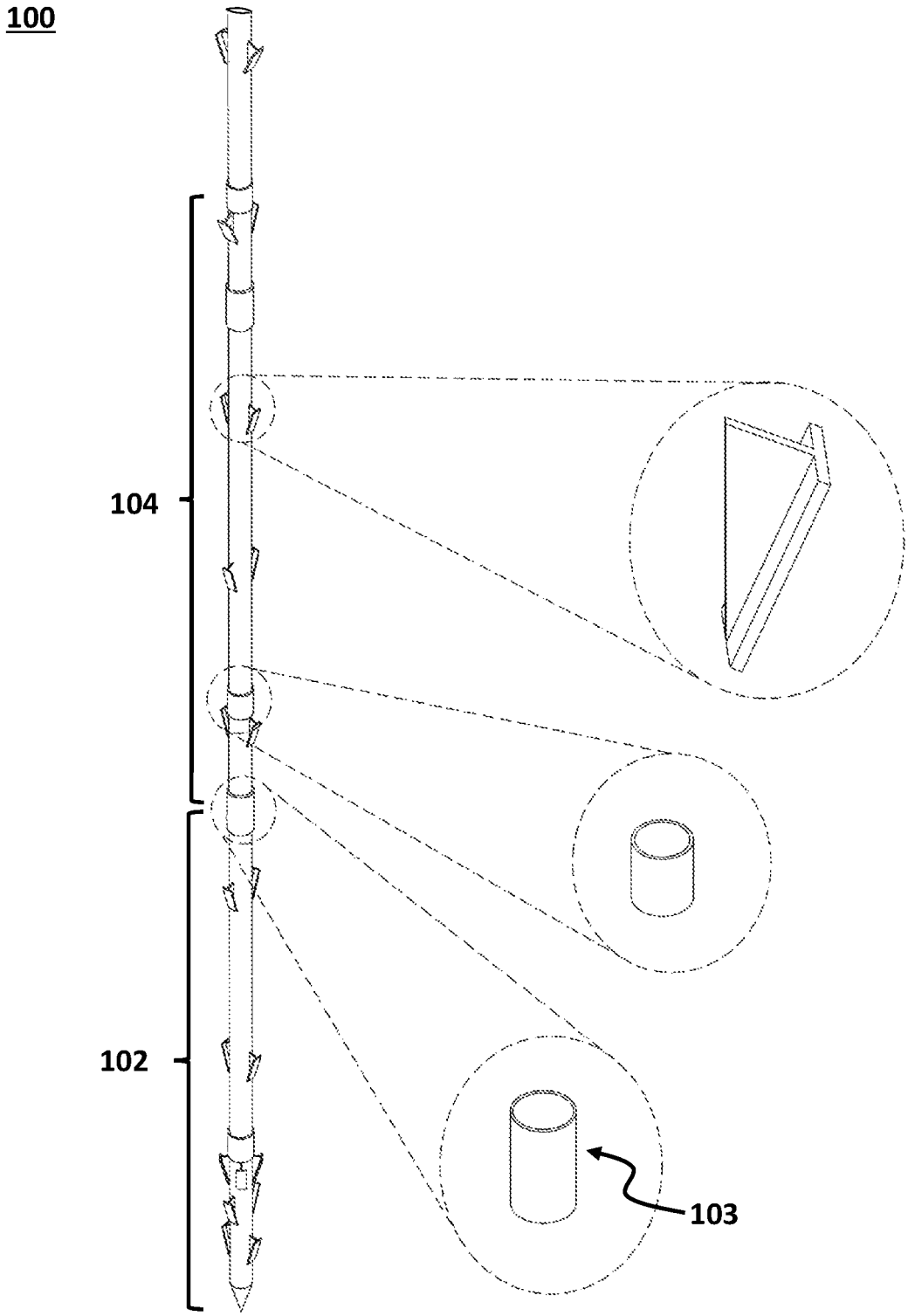
FIG. 1A illustrates a perspective view of an exemplary barbed micropile, consistent with one or more exemplary embodiments of the present disclosure.
Figure 1B:
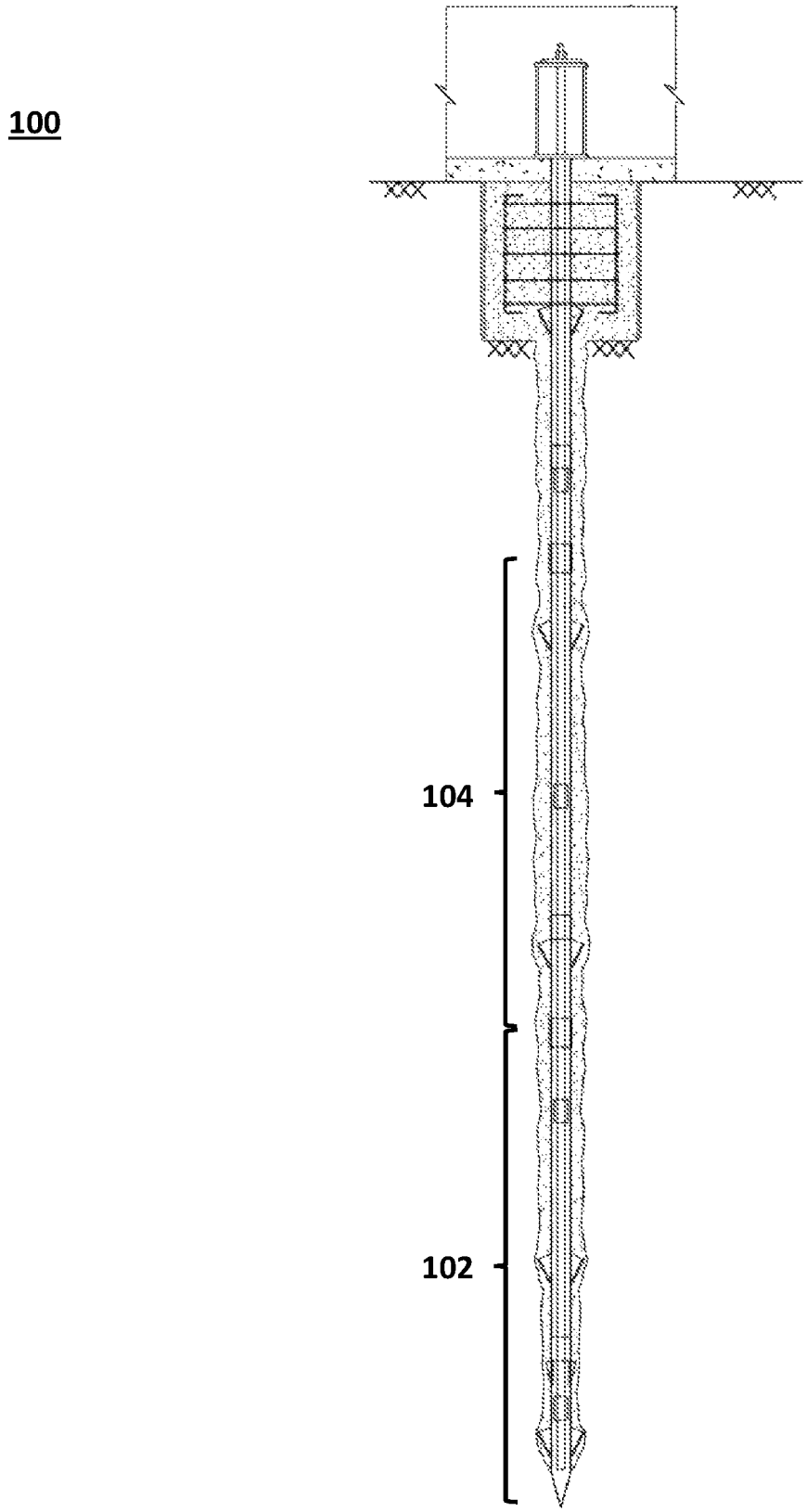
FIG. 1B illustrates a side view of an exemplary barbed micropile in a scenario in which a barbed micropile is inserted into the ground at a target location, consistent with one or more exemplary embodiments of the present disclosure.
Figure 2:
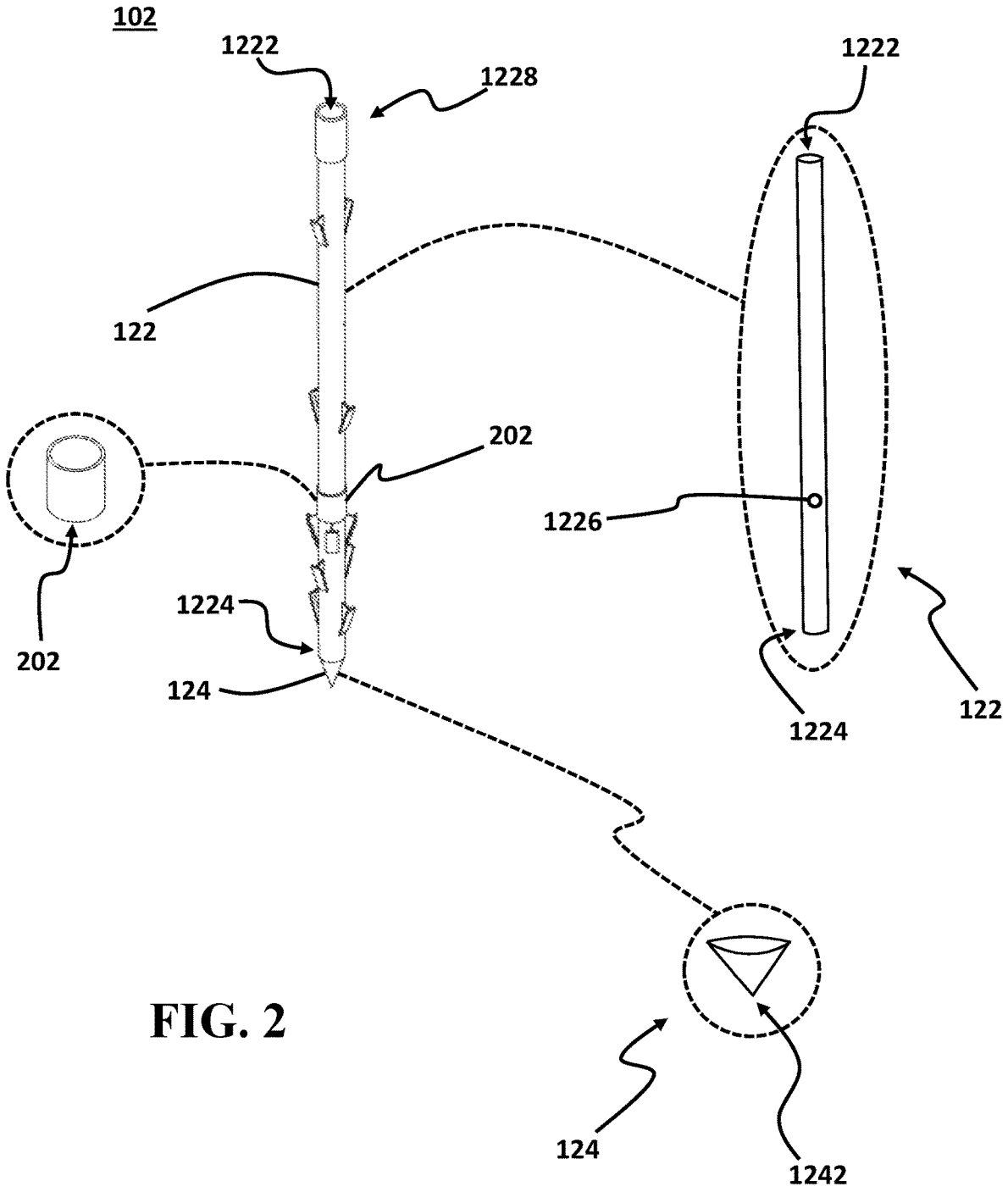
FIG. 2 illustrates a perspective view of an exemplary conical-head pipe, consistent with one or more exemplary embodiments of the present disclosure.

FIG. 1A shows a perspective view of a barbed micropile 100, consistent with one or more exemplary embodiments of the present disclosure. FIG. 1B shows a side view of barbed micropile 100 in a scenario in which barbed micropile 100 is inserted into the ground at a target location, consistent with one or more exemplary embodiments of the present disclosure. As shown in FIG. 1A and FIG. 1B, in an exemplary embodiment, barbed micropile 100 may include a conical-head pipe 102. FIG. 2 shows a perspective view of conical-head pipe 102, consistent with one or more exemplary embodiments of the present disclosure. As shown in FIG. 2, in an exemplary embodiment, conical-head pipe 102 may include a hollow rod 122 and a conical head 124. In an exemplary embodiment, hollow rod 122 may include an inner chamber 1222. In an exemplary embodiment, inner chamber 1222 of hollow rod 122 may be filled with grout. In an exemplary embodiment, conical head 124 may be attached to a bottom end 1224 of hollow rod 122. In an exemplary embodiment, conical head 124 may include a sharp tip 1242. In an exemplary embodiment, sharp tip 1242 may refer to a point at a bottom end of conical head 124 that may be able to cut or pierce something. In an exemplary embodiment, conical head 124 may facilitate penetration of conical-head pipe 102 into soil. In an exemplary embodiment, exemplary conical head 124 may make it easier for an operator and/or a hammering machine to insert conical-head pipe 102 to the ground. In an exemplary embodiment, due to sharpness of sharp tip 1242 at a bottom end of conical head 124, conical head 124 may be penetrated into soil with applying a relatively low force and consequently a lower energy may be needed for an operator and/or a hammering machine to insert conical-head pipe 102 to the ground.

Figure 3:
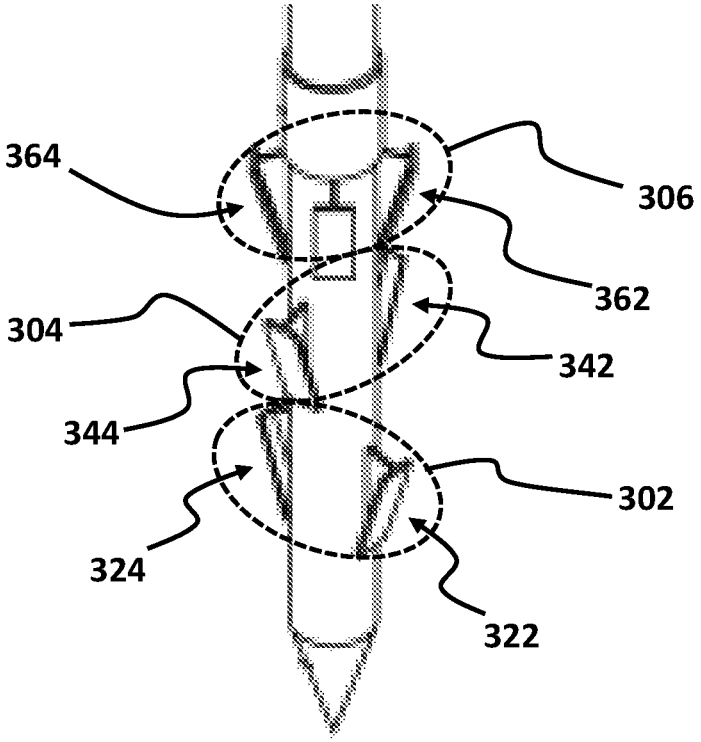
FIG. 3 illustrates a perspective view of an exemplary conical-head pipe, consistent with one or more exemplary embodiments of the present disclosure.

In an exemplary embodiment, conical-head pipe 102 may further include a plurality of T-shaped elements mounted around on an outer surface of hollow rod 122. FIG. 3 shows a perspective view of conical-head pipe 102, consistent with one or more exemplary embodiments of the present disclosure. In an exemplary embodiment, the plurality of T-shaped elements may include a plurality of pairs of T-shaped element such as a first pair of T-shaped elements 302, a second pair of T-shaped elements 304, and a third pair of T-shaped elements 306. In an exemplary embodiment, each respective pair of T-shaped elements from the plurality of pair of T-shaped elements may include two respective T-shaped elements. For example, first pair of T-shaped elements 302 may include a first T-shaped element 322 and a second T-shaped element 324. In an exemplary embodiment, second pair of T-shaped elements 304 may include a third T-shaped element 342 and a fourth T-shaped element 344. In an exemplary embodiment, third pair of T-shaped elements 306 may include a fifth T-shaped element 362 and a sixth T-shaped element 364. In an exemplary embodiment, respective T-shaped elements of each respective pair of T-shaped elements from the plurality of pair of T-shaped elements may be attached in front of each other to the outer surface of hollow rod 122. In an exemplary embodiment, the plurality of T-shaped elements may include more T-shaped elements in addition to first T-shaped element 322, second T-shaped element 324, third T-shaped element 342, fourth T-shaped element 344, fifth T-shaped element 362, and sixth T-shaped element 364. In an exemplary embodiment, all T-shaped elements of the plurality of T-shaped elements may be substantially similar in size and shape to each other.

Figure 4A:
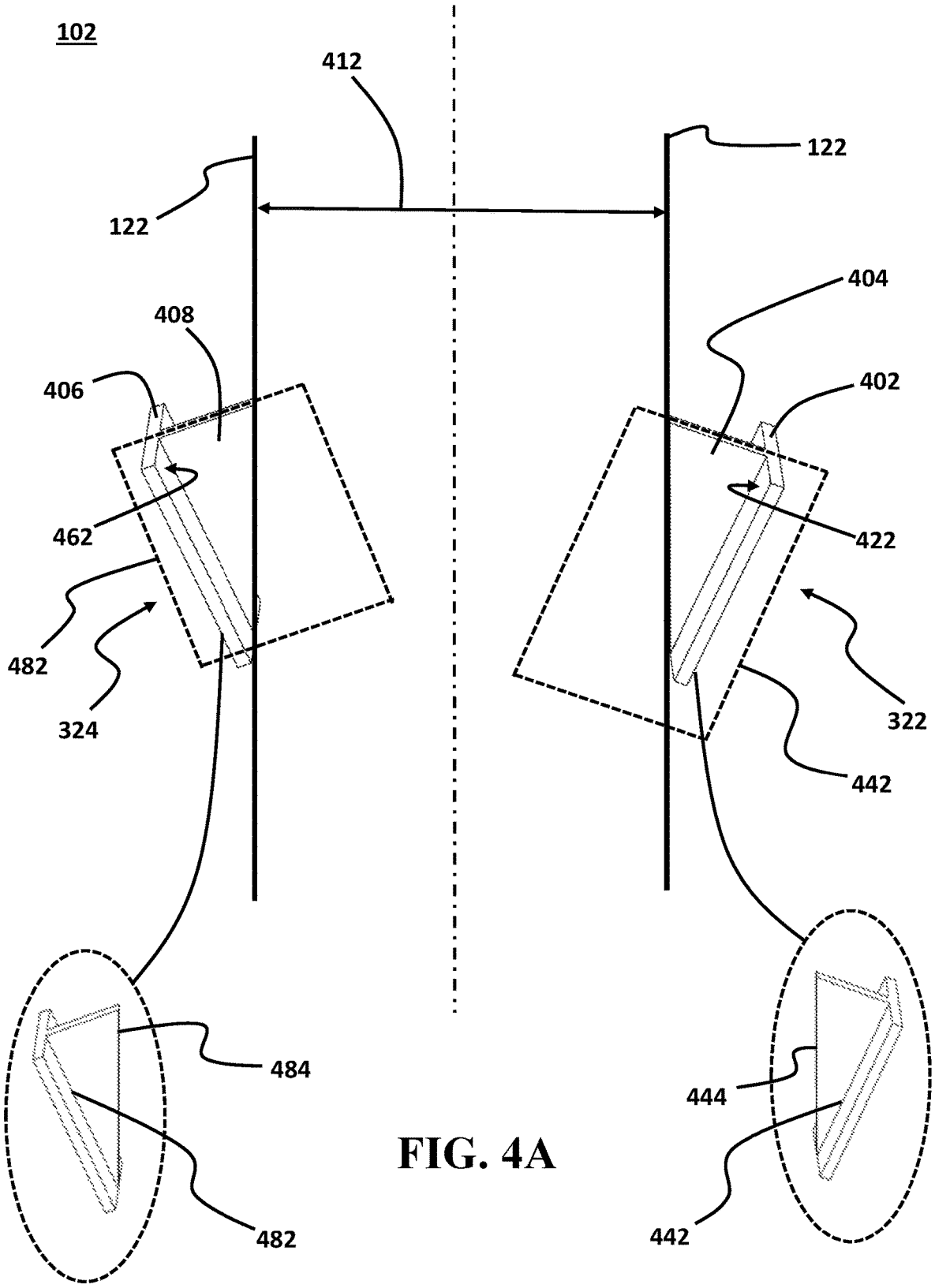
FIG. 4A illustrate an exemplary first pair of T-shaped elements, consistent with one or more exemplary embodiments of the present disclosure.

FIG. 4A shows first pair of T-shaped elements 302, consistent with one or more exemplary embodiments of the present disclosure. As shown in FIG. 4A, in an exemplary embodiment, first T-shaped element 322 may include a first rectangular-shaped plate 402 and a first triangular-shaped plate 404. In an exemplary embodiment, first rectangular-shaped plate 402 may include a first rectangular face 422. In an exemplary embodiment, first triangular-shaped plate 404 may include a first edge 442 and a second edge 444. In an exemplary embodiment, first edge 442 of first triangular-shaped plate 404 may be attached to first rectangular face 422 of first rectangular-shaped plate 402. In an exemplary embodiment, first edge 442 of first triangular-shaped plate 404 may be attached to first rectangular face 422 of first rectangular-shaped plate 402 through a welding process. However, in an exemplary embodiment, first triangular-shaped plate 404 and first rectangular-shaped plate 402 may be manufactured seamlessly to create an integrated part. In an exemplary embodiment, second edge 444 of first rectangular-shaped plate 402 may be attached to the outer surface of hollow rod 122. In an exemplary embodiment, second T-shaped element 324 may include a second rectangular-shaped plate 406 and a second triangular-shaped plate 408. In an exemplary embodiment, second rectangular-shaped plate 406 may include a second triangular face 462. In an exemplary embodiment, second triangular-shaped plate 408 may include a third edge 482 and a fourth edge 484. In an exemplary embodiment, third edge 482 of second triangular-shaped plate 408 may be attached to second rectangular face 462 of second rectangular-shaped plate 406. In an exemplary embodiment, fourth edge 484 of second triangular-shaped plate 408 may be attached to the outer surface of hollow rod 122.

In an exemplary embodiment, first T-shaped element 322 and second T-shaped element 324 may be attached in front of each other to outer surface of hollow rod 122. In an exemplary embodiment, an exemplary first T-shaped element being attached in front of an exemplary second T-shaped element to outer surface of hollow rod 122 may refer to an exemplary first T-shaped element and an exemplary second T-shaped element being attached to opposite sides of outer surface of hollow rod 122 in such a way that a main plane of an exemplary first triangular-shaped plate of an exemplary first T-shaped element is aligned with a main plane of an exemplary second triangular-shaped plate of an exemplary second T-shaped element. For example, first T-shaped element 322 and second T-shaped element 324 may be attached to opposite sides of outer surface of hollow rod 122 in such a way that a main plane 442 of first triangular-shaped plate 404 is aligned with a main plane 482 of second triangular-shaped plate 408. In an exemplary embodiment, third T-shaped element 342 and fourth T-shaped element 344 may be attached in front of each other to outer surface of hollow rod 122. In an exemplary embodiment, fifth T-shaped element 362 and sixth T-shaped element 364 may be attached in front of each other to outer surface of hollow rod 122.

Figure 4B:
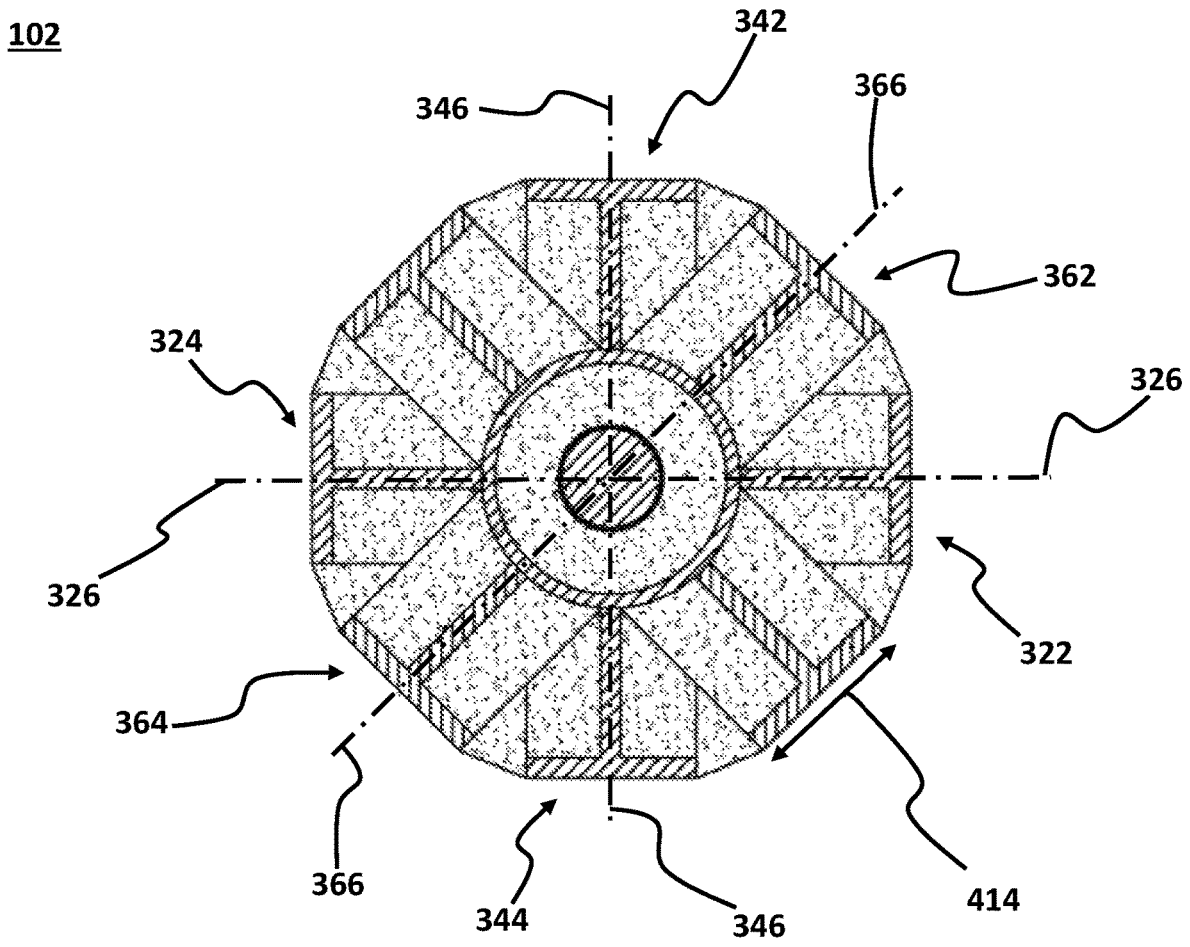
FIG. 4B illustrates a top view of an exemplary conical-head pipe, consistent with one or more exemplary embodiments of the present disclosure.

FIG. 4B shows a top view of conical-head pipe 102, consistent with one or more exemplary embodiments of the present disclosure. As shown in FIG. 4B, in an exemplary embodiment, first pair of T-shaped elements 302 and second pair of T-shaped elements 304 may be mounted around the outer surface of hollow rod 122 in such a way that a main plane 326 of first pair of T-shaped elements 302 is substantially perpendicular to a main plane 346 of second pair of T-shaped elements 304. In an exemplary embodiment, third pair of T-shaped elements 306 may be mounted around the outer surface of hollow rod 122 in such a way that a main plane 366 of third pair of T-shaped elements 306 defines a substantially 45° angle with main plane 326 of first pair of T-shaped elements 302 and a substantially 45° angle with main plane 346 of second pair of T-shaped elements 304. In an exemplary embodiment, it may be understood that the aforementioned arrangement of first pair of T-shaped elements 302, second pair of T-shaped elements 304, and third pair of T-shaped elements 306 may provide significant benefits. For example, the aforementioned arrangement of first pair of T-shaped elements 302, second pair of T-shaped elements 304, and third pair of T-shaped elements 306 may help conical-head pipe 102 to create a well inside the ground when it is inserted into the ground. As shown in FIG. 4A and FIG. 4B, in an exemplary embodiment, a width 414 of a T-shaped element from the plurality of T-shaped elements may be between 0.5 and 0.9 of a diameter 412 of hollow rod 122. In an exemplary embodiment, width 414 of a T-shaped element from the plurality of T-shaped elements may be 0.8 of diameter 412 of hollow rod 122. For example, a width of second T-shaped element 324 may be 0.8 of diameter 412 of hollow rod 122.

As further shown in FIG. 2, in an exemplary embodiment, conical-head pipe 102 may further include a thorough injection hole 1226 on the outer surface of hollow rod 122. In an exemplary embodiment, thorough injection hole 1226 may provide a facility for conical-head pipe 102 to help grout to discharge from inner chamber 1222 of hollow rod 122 to an outer space of conical-head pipe 102. In an exemplary embodiment, when conical-head pipe 102 is inserted into the ground, grout may be injected into the created well around the conical-head pipe 102 by injecting the grout into inner chamber 1222 of hollow rod 122. In an exemplary embodiment, grout may be discharged from inner chamber 1222 of hollow rod 122 to the created well around conical-head pipe 102 through thorough injection hole 1226 and fill the created well. In an exemplary embodiment, grout may be discharge through thorough injection hole 1226 due to higher fluid pressure of grout inside inner chamber 1222 of hollow rod 122

In an exemplary embodiment, conical-head pipe 102 may further include a cylindrical elastic casing 202. In an exemplary embodiment, cylindrical elastic casing 202 may be made up of a deformable and flexible elastic material which may allow cylindrical elastic casing 202 to deform against external forces. In an exemplary embodiment, an inner dimeter of cylindrical elastic casing 202 may coincide with or correspond to an outer diameter of hollow rod 122. In an exemplary embodiment, an inner dimeter of cylindrical elastic casing 202 may be 0.2 mm greater than an outer diameter of hollow rod 122. In an exemplary embodiment, cylindrical elastic casing 202 may be mounted onto hollow rod 122 and at a location of thorough injection hole 1226. In an exemplary embodiment, cylindrical elastic casing 202 may completely cover thorough injection hole 1226. In an exemplary embodiment, cylindrical elastic casing 202 may provide significant benefits. For example, cylindrical elastic casing 202 may allow grout discharge from inner chamber 1222 of hollow rod 122 into the outer space of conical-head pipe 102. In an exemplary embodiment, cylindrical elastic casing 202 may also prevent grout penetration from the outer space of conical-head pipe 102 into inner chamber 1222 of hollow rod 122 through thorough injection hole 1226. In an exemplary embodiment, when cylindrical elastic casing 202 completely covers thorough injection hole 1226, grout may be prevented from penetration into inner chamber 1222 of hollow rod 122 through thorough injection hole 1226 due to the fact that cylindrical elastic casing 202 may block thorough injection hole 1226. In an exemplary embodiment, when conical-head pipe 102 is inserted to the ground, grout may be pumped into inner chamber 1222 of hollow rod 122 to fill a created well around conical-head pipe 102. In an exemplary embodiment, the pumped grout may be discharged from inner chamber 1222 of hollow rod 122 through thorough injection hole 1226. In an exemplary embodiment, it may be understood that due to the deformability and flexibility of cylindrical elastic casing 202, cylindrical elastic casing 202 may be deformed against a pressure of the pumped grout and, thereby, thorough injection hole 1226 may be unblocked and allow the pumped grout to discharge from inner chamber 1222 of hollow rod 122. Furthermore, cylindrical elastic casing 202 may prevent the grout from returning into inner chamber 1222 of hollow rod 122 through thorough injection hole 1226. In an exemplary embodiment, cylindrical elastic casing 202 may be made up of a flexible elastic. In an exemplary embodiment, the flexibility of cylindrical elastic casing 202 may provide a facility for cylindrical elastic casing 202 that allow grout to discharge from inner chamber 1222 of hollow rod 122 through thorough injection hole 1226 but does not allow the grout to return to inner chamber 1222 of hollow rod 122. In an exemplary embodiment, it may be understood that cylindrical elastic casing 202 may act as a check valve that may allow grout to discharge from inner chamber 1222 of hollow rod 122 through thorough injection hole 1226 but does not allow the grout to return to inner chamber 1222 of hollow rod 122.

Figure 5:
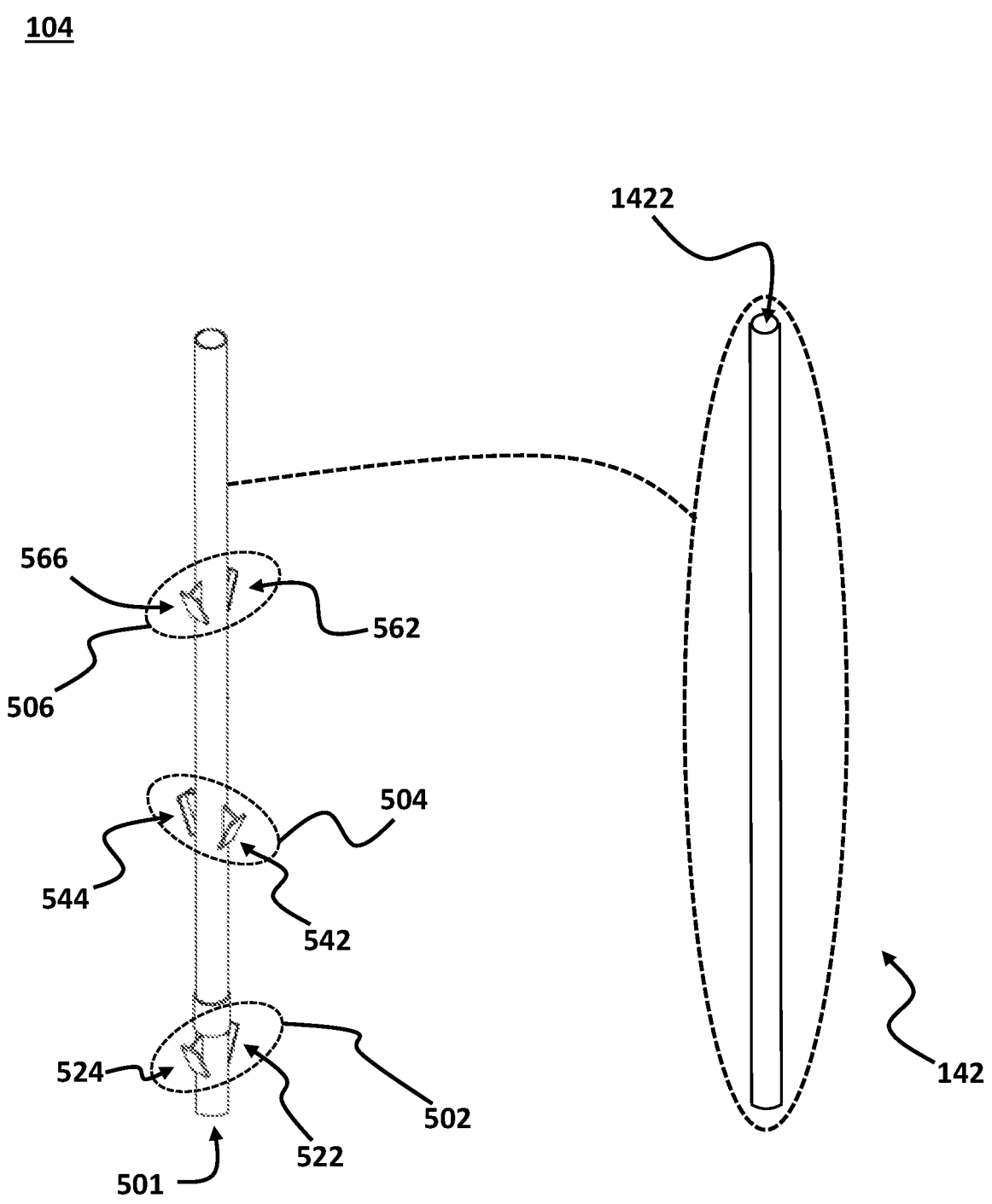
FIG. 5 illustrates an exemplary first pipe, consistent with one or more exemplary embodiments of the present disclosure.

As further shown in FIG. 1A and FIG. 1B, in an exemplary embodiment, barbed micropile 100 may further include a plurality of pipes including a first pipe 104. In an exemplary embodiment, the plurality of pipes may be installed onto the conical-head pipe 102. In an exemplary embodiment, all of the plurality of pipes may be similar in structure and functionality. FIG. 5 shows first pipe 104, consistent with one or more exemplary embodiments of the present disclosure. As shown in FIG. 5, in an exemplary embodiment, first pipe 104 may include a first hollow rod 142. In an exemplary embodiment, first hollow rod 142 may include a first inner chamber 1422. In an exemplary embodiment, first inner chamber 1422 of first hollow rod 142 may be filled with grout. In an exemplary embodiment, first pipe 104 may further include a first plurality of T-shaped elements mounted around an outer surface of first hollow rod 142. In an exemplary embodiment, first plurality of T-shaped elements may include a first plurality of pair of T-shaped elements such as a fourth pair of T-shaped elements 502, a fifth pair of T-shaped elements 504, and a sixth pair of T-shaped elements 506. In an exemplary embodiment, each of first plurality of pair of T-shaped elements may include two respective T-shaped elements. For example, fourth pair of T-shaped elements 502 may include a seventh T-shaped element 522 and an eighth T-shaped element 524. In an exemplary embodiment, fifth pair of T-shaped elements 504 may include a ninth T-shaped element 542 and a tenth T-shaped element 544. In an exemplary embodiment, sixth pair of T-shaped elements 506 may include an eleventh T-shaped element 562 and a twelfth T-shaped element 564. In an exemplary embodiment, T-shaped elements of each of first plurality of pair of T-shaped elements may be attached to the outer surface of first hollow rod 142 and in front of each other. In an exemplary embodiment, each of first plurality of T-shaped elements may be similar in structure and functionality to first T-shaped element 322 and a second T-shaped element 324. In an exemplary embodiment, a bottom end 501 of first pipe 104 may be attached to a top end 1228 of conical-head pipe 102. In an exemplary embodiment, bottom end 501 of first pipe 104 may be attached to top end 1228 of conical-head pipe 102 by utilizing a pipe coupling 103. In an exemplary embodiment, each pipe from the plurality of pipes may be installed onto a previously installed pipe from the plurality of pipes. In an exemplary embodiment, a bottom end of each of the plurality of pipes may be attached to a top end of the previously installed pipe.

Figure 6A:
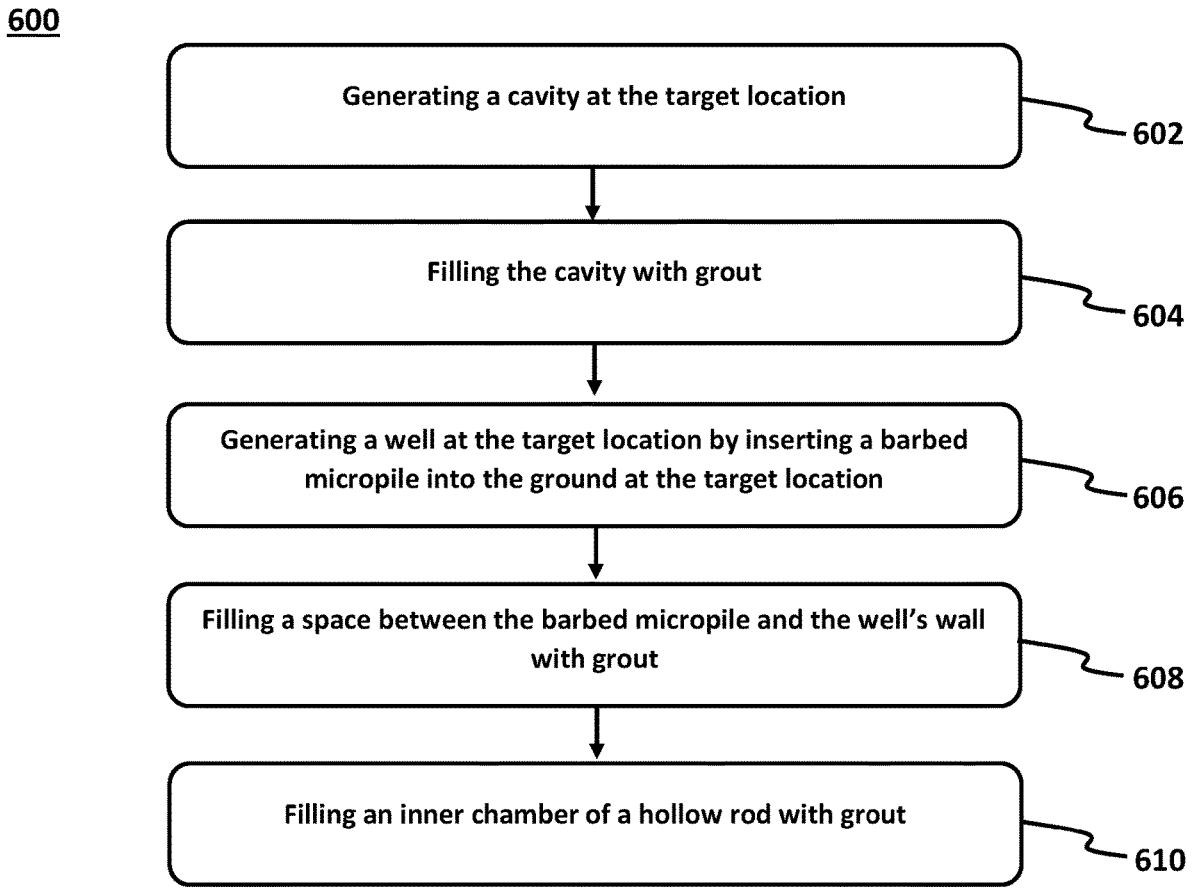
FIG. 6A illustrates an exemplary method for soil reinforcement at a target location, consistent with one or more exemplary embodiments of the present disclosure.
Figure 6B:
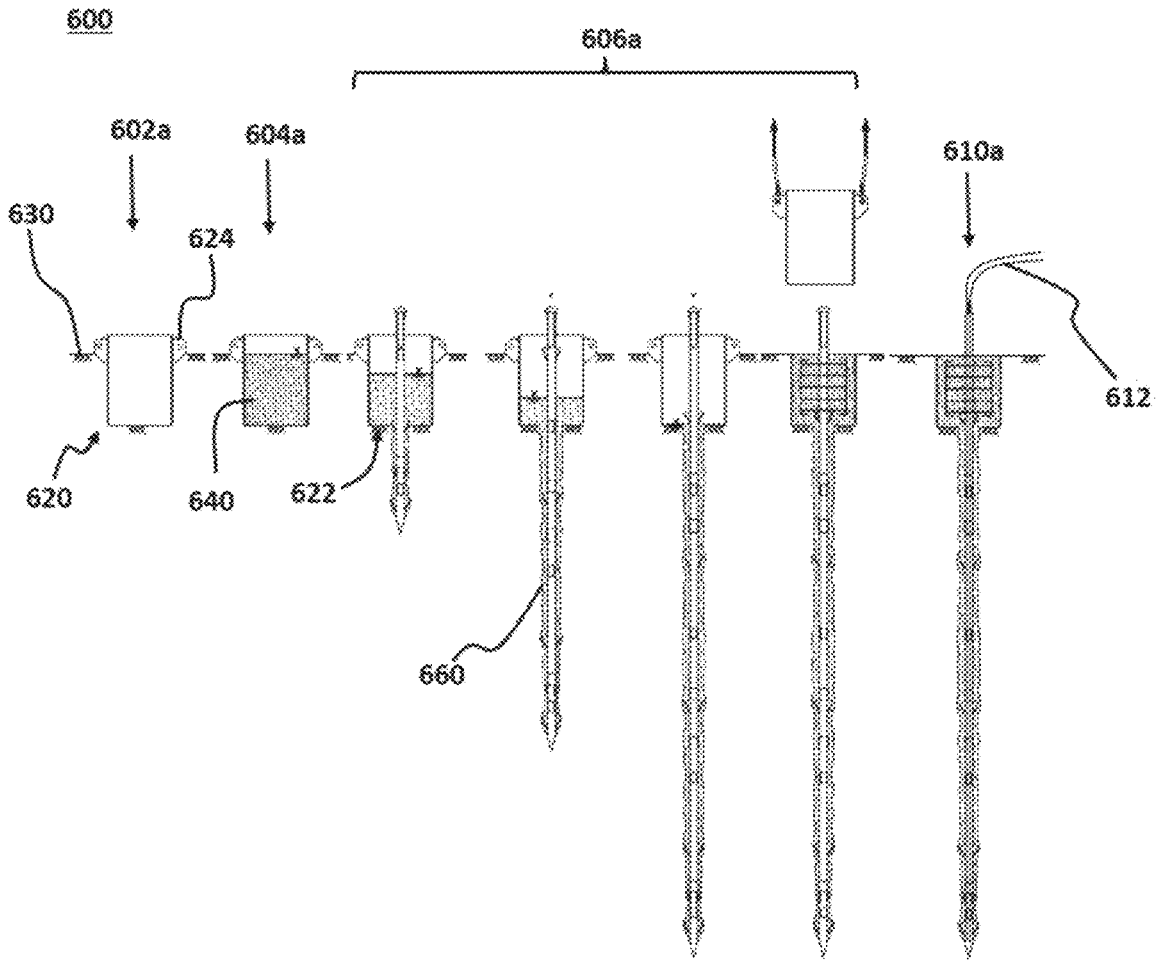
FIG. 6B illustrates a schematic implementation of an exemplary method for soil reinforcement at a target location, consistent with one or more exemplary embodiments of the present disclosure.

FIG. 6A is a method 600 for soil reinforcement at a target location, consistent with one or more exemplary embodiments of the present disclosure. FIG. 6B shows a schematic implementation of method 600 for soil reinforcement at a target location, consistent with one or more exemplary embodiments of the present disclosure. As shown in FIG. 6A, in an exemplary embodiment, method 600 may include a step 602 of generating a cavity at a target location, a step 604 of filling the cavity with grout, a step 606 of generating a well at the target location by inserting a barbed micropile into the ground at the target location, a step 608 of filling a space between the barbed micropile and the well's wall with grout, and a step 610 of filling an inner chamber of a hollow rod with grout. In an exemplary embodiment, step 602*a* in FIG. 6B may correspond to step 602 of method 600 in FIG. 6A. In an exemplary embodiment, step 604*a* in FIG. 6B may correspond to step 604 of method 600 in FIG. 6A. In an exemplary embodiment, step 606*a* in FIG. 6B may correspond to step 606 of method 600 in FIG. 6A. In an exemplary embodiment, step 610*a* in FIG. 6B may correspond to step 610 of method 600 in FIG. 6A.

Figure 7A:
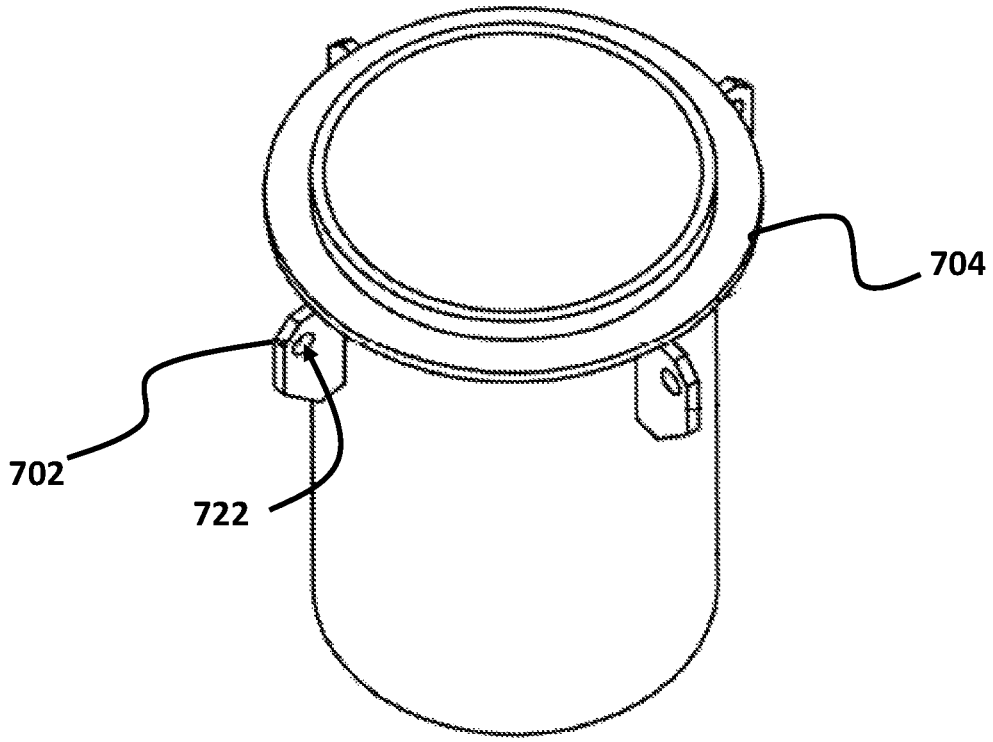
FIG. 7A illustrates a perspective view of a casing pipe, consistent with one or more exemplary embodiments of the present disclosure.
Figure 7B:
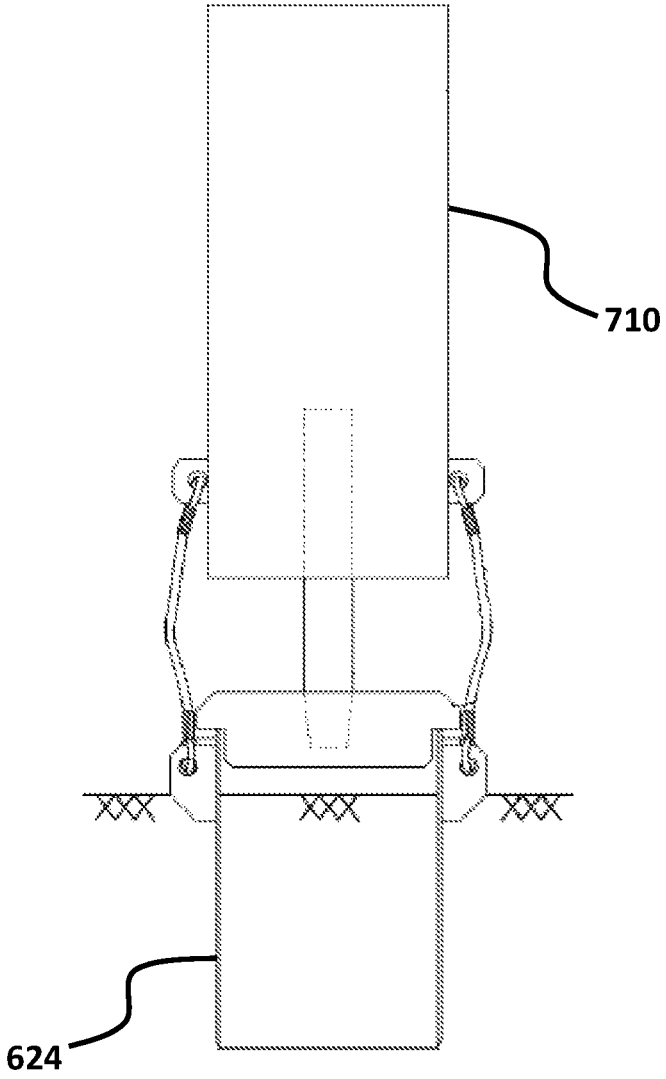
FIG. 7B illustrates a side view of a casing pipe in a scenario in which a casing pipe is inserted into a ground at a target location, consistent with one or more exemplary embodiments of the present disclosure.

In an exemplary embodiment, in order to implement step 602 of method 600, a cavity 620 may be generated at the target location. In an exemplary embodiment, cavity 620 may be created by driving a casing pipe 624 into a ground 630 at the target location utilizing a mechanical hammer. FIG. 7A shows a perspective view of casing pipe 624, consistent with one or more exemplary embodiments of the present disclosure. As shown in FIG. 7A, in an exemplary embodiment, a plurality of gripping members such as first gripping member 702 may be attached around on an outer surface of casing pipe 624. In an exemplary embodiment, first gripping member 702 may include a gripping hole 722. In an exemplary embodiment, the plurality of gripping members may be configured to be attached to a mechanical hammer. In an exemplary embodiment, a hook of a mechanical hammer may be engaged with gripping hole 722. In an exemplary embodiment, a mechanical hammer may pull out casing pipe 624 from ground 630 by pulling up the hook of the mechanical hammer. In an exemplary embodiment, the plurality of gripping members may include more gripping members in addition to first gripping member 702 which are shown in FIG. 7A but are not labeled. In an exemplary embodiment, the more gripping members of the plurality of gripping members may be similar in structure and function to first gripping member 702. In an exemplary embodiment, casing pipe 624 may further include a top ring 704 attached to a top end of casing pipe 624 and to the plurality of gripping members. FIG. 7B shows a side view of casing pipe 624 in a scenario in which casing pipe 624 is inserted into ground 630 at the target location, consistent with one or more exemplary embodiments of the present disclosure. As shown in FIG. 7B, a mechanical hammer such as an exemplary mechanical hammer 710 may be used to insert casing pipe 624 into ground 630 and pull out casing pipe 624 from ground 630.

In an exemplary embodiment, in order to implement step 604 of method 600, cavity 620 may be filled with grout 640. In an exemplary embodiment, in order to implement step 606 of method 600, a barbed micropile such as barbed micropile 100, as shown in FIG. 1A, may be inserted into the ground at the target location. In an exemplary embodiment, a barbed micropile such as barbed micropile 100 may be driven into the ground at a bottom 622 of cavity 620 by utilizing a mechanical hammer. In an exemplary embodiment, a well 660 may be generated in the ground by inserting barbed micropile 100 into the ground.

As shown in FIG. 6B, in an exemplary embodiment, during insertion of barbed micropile 100 into ground 630 at bottom 622 of cavity 620, the grout contained in cavity 620 may flow into a space (not labeled) between barbed micropile 100 and well's 660 wall. In an exemplary embodiment, during insertion of barbed micropile 100 into ground 630 at bottom 622 of cavity 620, grout may continuously be poured into cavity 620 to ensure that during insertion of barbed micropile 100 into ground 630 at bottom 622 of cavity 620, the space between barbed micropile 100 and well's 660 wall is fully filled with grout. In an exemplary embodiment, the space between barbed micropile 100 and well's 660 wall being fully filled with grout may refer to a scenario in which grout is poured into the space between barbed micropile 100 and well's 660 wall until the grout level reaches bottom 622 of cavity 620. In an exemplary embodiment, it may be understood that during insertion of barbed micropile 100 into ground 630 at bottom 622 of cavity 620, grout may flow into the space between barbed micropile 100 and well's 660 wall due to the gravity force.

In an exemplary embodiment, in order to implement step 610 of method 600, grout may be injected into barbed micropile 100 as shown in step 610*a* in FIG. 6B. In an exemplary embodiment, grout may be injected into barbed micropile 100 by utilizing a tremie pipe 612. In an exemplary embodiment, when grout is injected into barbed micropile 100, the grout may be discharged from inner chamber 1222 of hollow rod 122 into the space between barbed micropile 100 and well's 660 wall through thorough injection hole 1226. In an exemplary embodiment, cylindrical elastic casing 202 may prevent grout penetration into inner chamber 1222 of hollow rod 122 from the space between barbed micropile 100 and well's 660 wall.

Figure 8A:
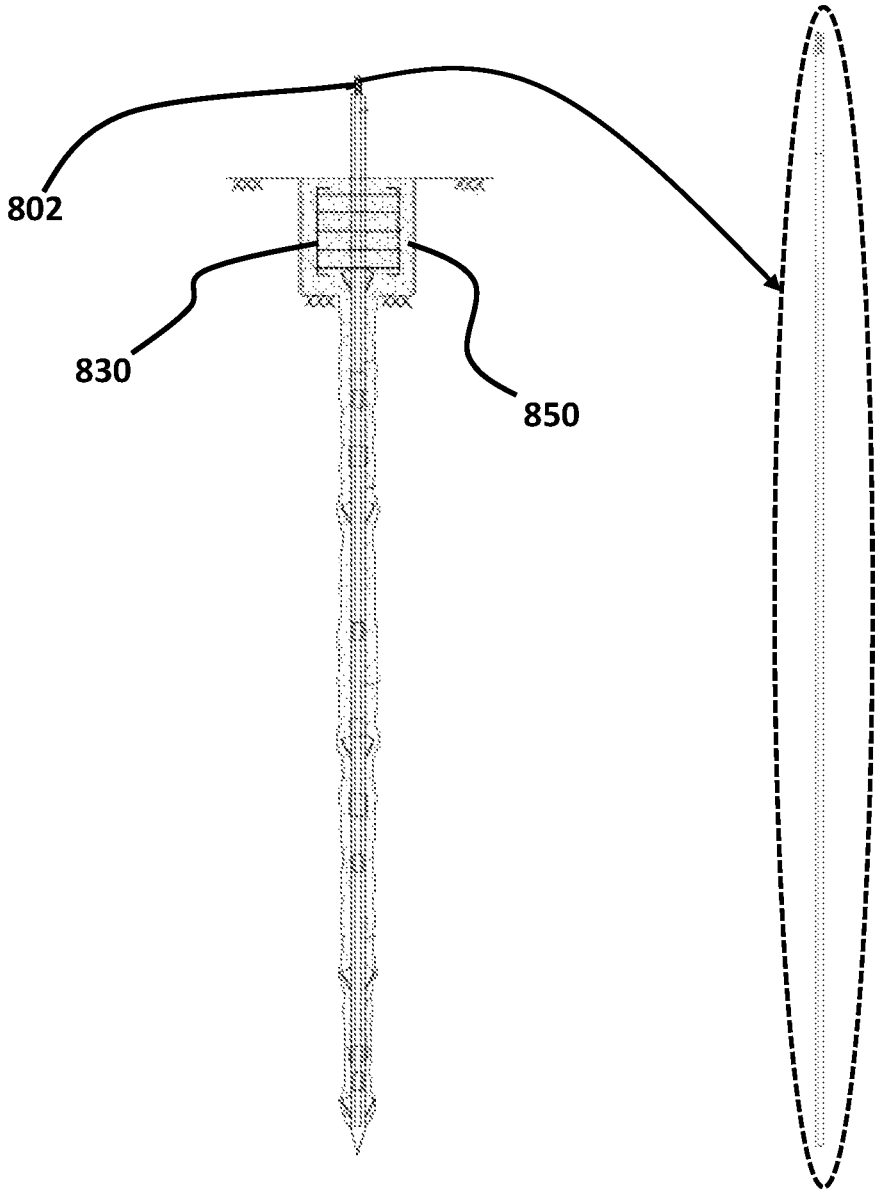
FIG. 8A illustrates a barbed micropile in a scenario in which a reinforcement rebar is inserted into a barbed micropile, consistent with one or more exemplary embodiments of the present disclosure.

In an exemplary embodiment, before complete solidification of the grout inside barbed micropile 100, a reinforcement rebar may be inserted into barbed micropile 100 and then a stiffener mechanism may be attached to a top end of the reinforcement rebar. FIG. 8A shows barbed micropile 100 in a scenario in which a reinforcement rebar is inserted into barbed micropile 100, consistent with one or more exemplary embodiments of the present disclosure. As shown in FIG. 8A, a reinforcement bar 802 may be inserted into barbed micropile 100.

In an exemplary embodiment, before inserting reinforcement bar 802 into barbed micropile 100, casing pipe 624 may be pulled out from cavity 620 by utilizing a mechanical hammer such as mechanical hammer 710. Then, in an exemplary embodiment, an armature assembly 830 may be disposed inside cavity 620 and then an amount of cement may be poured into cavity 620 to form a cement block 840.

Figure 8B:
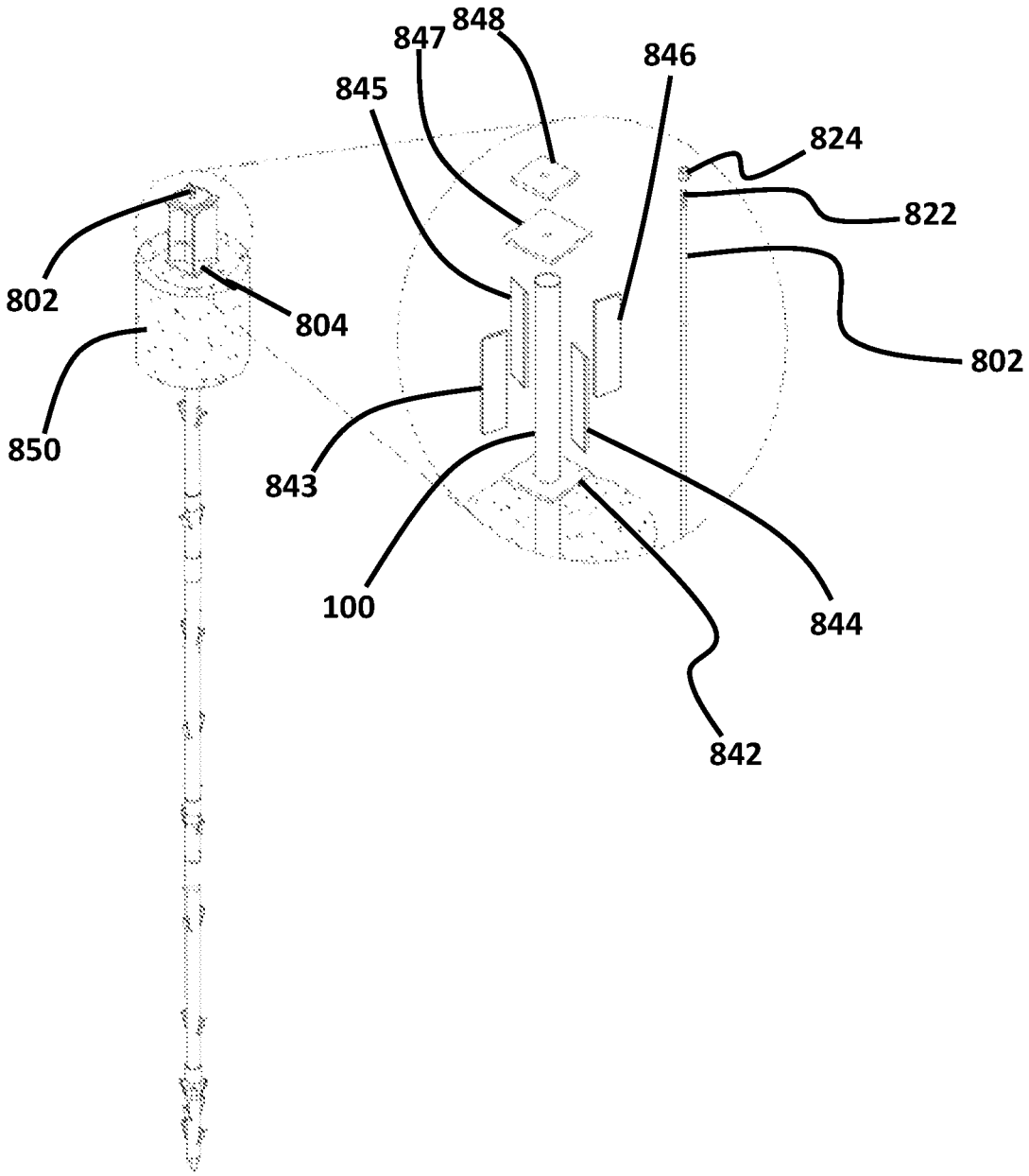
FIG. 8B illustrates a perspective view of a barbed micropile in a scenario in which a reinforcement rebar is inserted into a barbed micropile, consistent with one or more exemplary embodiments of the present disclosure.

FIG. 8B shows a perspective view of barbed micropile 100 in a scenario in which reinforcement rebar 802 is inserted into barbed micropile 100, consistent with one or more exemplary embodiments of the present disclosure. As shown in FIG. 8B, in an exemplary embodiment, a stiffener assembly 804 may be attached to a top end of reinforcement rebar 802 and a top end of barbed micropile 100. As shown in FIG. 8B, in an exemplary embodiment, stiffener assembly 804 may include a first horizontal plate 842 attached to barbed micropile 100. In an exemplary embodiment, first horizontal plate 842 may include a hole at a middle of first horizontal plate 842. In an exemplary embodiment, barbed micropile 100 may be inserted into the hole of first horizontal plate 842. In an exemplary embodiment, stiffener assembly 804 may further include a first vertical plate 843, a second vertical plate 844, a third vertical plate 845, and a fourth vertical plate 846. In an exemplary embodiment, first vertical plate 843, second vertical plate 844, third vertical plate 845, and fourth vertical plate 846 may be attached around on an outer surface of barbed micropile 100.

In an exemplary embodiment, stiffener assembly 804 may further include a second horizontal plate 847 and a third horizontal plate 848. In an exemplary embodiment, second horizontal plate 847 may be placed onto first vertical plate 843, second vertical plate 844, third vertical plate 845, fourth vertical plate 846, and a top end of barbed micropile 100. In an exemplary embodiment, third horizontal plate 848 may be placed onto second horizontal plate 847. In an exemplary embodiment, reinforcement bar 802 may be inserted into a hole of second horizontal plate 847 and a hole of third horizontal plate 848. In an exemplary embodiment reinforcement bar 802 may include an externally threaded section 822 on a top end of reinforcement bar 802. In an exemplary embodiment, a nut 824 with an internally threaded section may be screwed onto externally threaded section 822 to secure horizontal plate 847 and third horizontal plate 848 at their place.

Figure 9A:
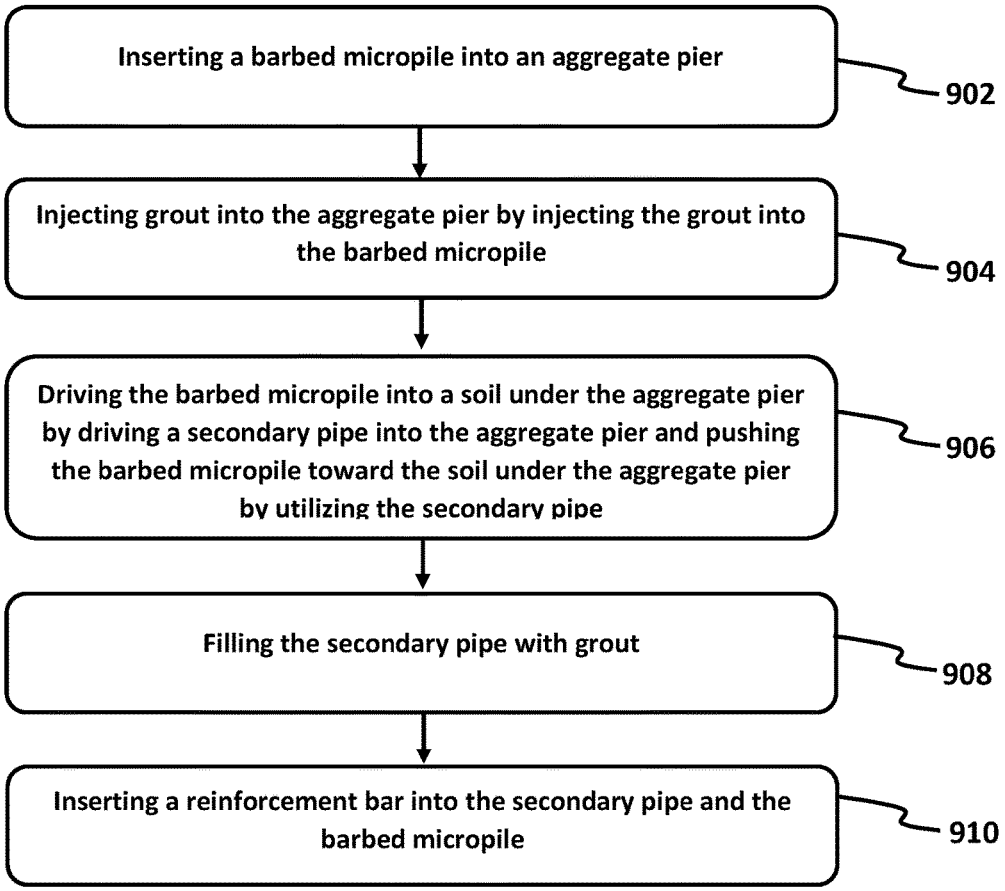
FIG. 9A is a method for reinforcing an aggregate pier, consistent with one or more exemplary embodiments of the present disclosure.
Figure 9B:
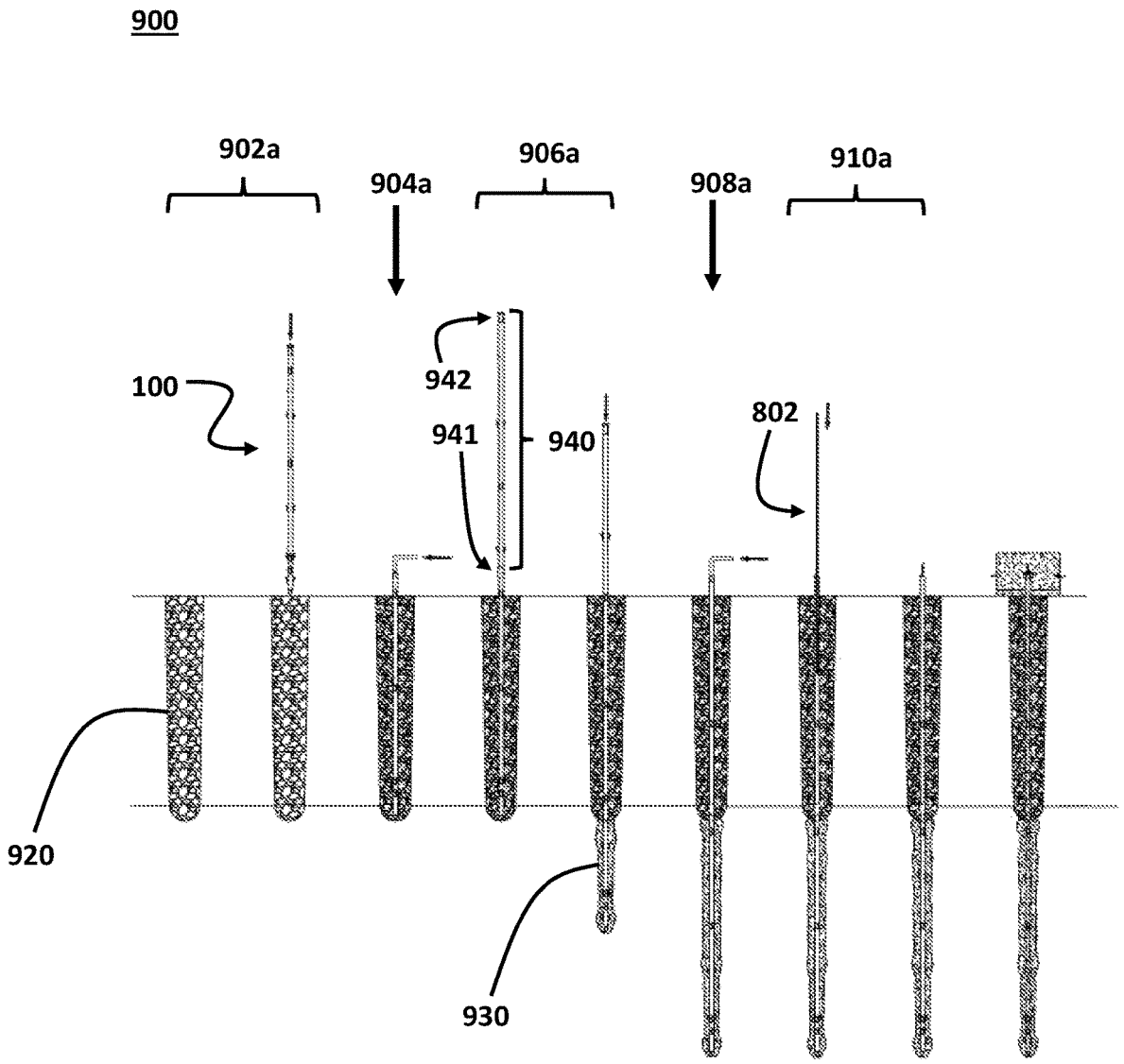
FIG. 9B illustrates a schematic implementation of a method for reinforcing an aggregate pier, consistent with one or more exemplary embodiments of the present disclosure.

FIG. 9A is a method 900 for reinforcing an aggregate pier, consistent with one or more exemplary embodiments of the present disclosure. FIG. 9B shows a schematic implementation of method 900 for reinforcing an aggregate pier, consistent with one or more exemplary embodiments of the present disclosure. As shown in FIG. 9A, in an exemplary embodiment, method 900 may include a step 902 of inserting a barbed micropile into the aggregate pier, a step 904 of injecting grout into the aggregate pier by injecting the grout into the barbed micropile, a step 906 of driving the barbed micropile into a soil under the aggregate pier by driving a secondary pipe into the aggregate pier and pushing the barbed micropile toward the soil under the aggregate pier by utilizing the secondary pipe, a step 908 of filling the secondary pipe with grout, and a step 910 of inserting a reinforcement bar into the secondary pipe and the barbed micropile. In an exemplary embodiment, step 902*a* in FIG. 9B may correspond to step 902 of method 900 in FIG. 9A. In an exemplary embodiment, step 904*a* in FIG. 9B may correspond to step 904 of method 900 in FIG. 9A. In an exemplary embodiment, step 906*a* in FIG. 9B may correspond to step 906 of method 900 in FIG. 9A. In an exemplary embodiment, step 910*a* in FIG. 9B may correspond to step 910 of method 900 in FIG. 9A.

In an exemplary embodiment, with further details with regards to step 902, inserting a barbed micropile into the aggregate pier may comprise, for example, inserting a barbed micropile such as barbed micropile 100, as shown in FIG. 1A, into an aggregate pier 920. In an exemplary embodiment, barbed micropile 100 may be inserted into an aggregate pier 920 by utilizing a mechanical hammer such as mechanical hammer 710. In an exemplary embodiment, with further details with regards to step 904, injecting grout into the aggregate pier by injecting the grout into the barbed micropile may comprise, for example, injecting grout into aggregate pier 920 by injecting the grout into a barbed micropile, such as barbed micropile 100. In an exemplary embodiment, injecting grout into barbed micropile 100 may continue until aggregate pier 920 and barbed micropile 100 are filled with grout. In other words, injecting grout into barbed micropile 100 may continue until pore space inside aggregate pier 920 and inner chamber 1222 of hollow rod 122 are fully filled with grout.

In an exemplary embodiment, with further details with regards to step 906, driving the barbed micropile into a soil under the aggregate pier by driving a secondary pipe into the aggregate pier and pushing the barbed micropile toward the soil under the aggregate pier by utilizing the secondary pipe may comprise, for example, driving barbed micropile 100 into a soil 930 under aggregate pier 920. In an exemplary embodiment, driving barbed micropile 100 into soil 930 under aggregate pier 920 may be done by utilizing a secondary pipe 940. In an exemplary embodiment, a bottom end of secondary pipe 940 may be abutted with a top end of barbed micropile 100. In an exemplary embodiment, after abutting the bottom end of secondary pipe 940 with the top end of barbed micropile 100, secondary pipe 940 and barbed micropile 100 may be connected and aligned with each other by utilizing a coupler 941. Then, in an exemplary embodiment, secondary pipe 940 may be pushed toward barbed micropile 100 by utilizing a mechanical hammer such as mechanical hammer 710. In an exemplary embodiment, by pushing secondary pipe 940 toward barbed micropile 100, barbed micropile 100 may be driven into soil 930 under aggregate pier 920.

In an exemplary embodiment, with further details with regards to 908 of method 900, filling the secondary pipe with grout may comprise, for example, filling secondary pipe 940 with grout. In an exemplary embodiment, with further details with regards to step 910 of method 900, inserting a reinforcement bar into the secondary pipe and the barbed micropile may comprise, for example, inserting a reinforcement bar such as reinforcement bar 802 into secondary pipe 940 and barbed micropile 100. In an exemplary embodiment, reinforcement bar 802 may be inserted into secondary pipe 940 and barbed micropile 100 when the grout inside secondary pipe 940 and barbed micropile 100 is not dried yet. In an exemplary embodiment, when grout is dried, secondary pipe 940, barbed micropile 100, and aggregate pier 920 may strongly be connected to each other which may help aggregate pier 920 to withstand against axial loads from buildings and/or structures.

Figure 10A:
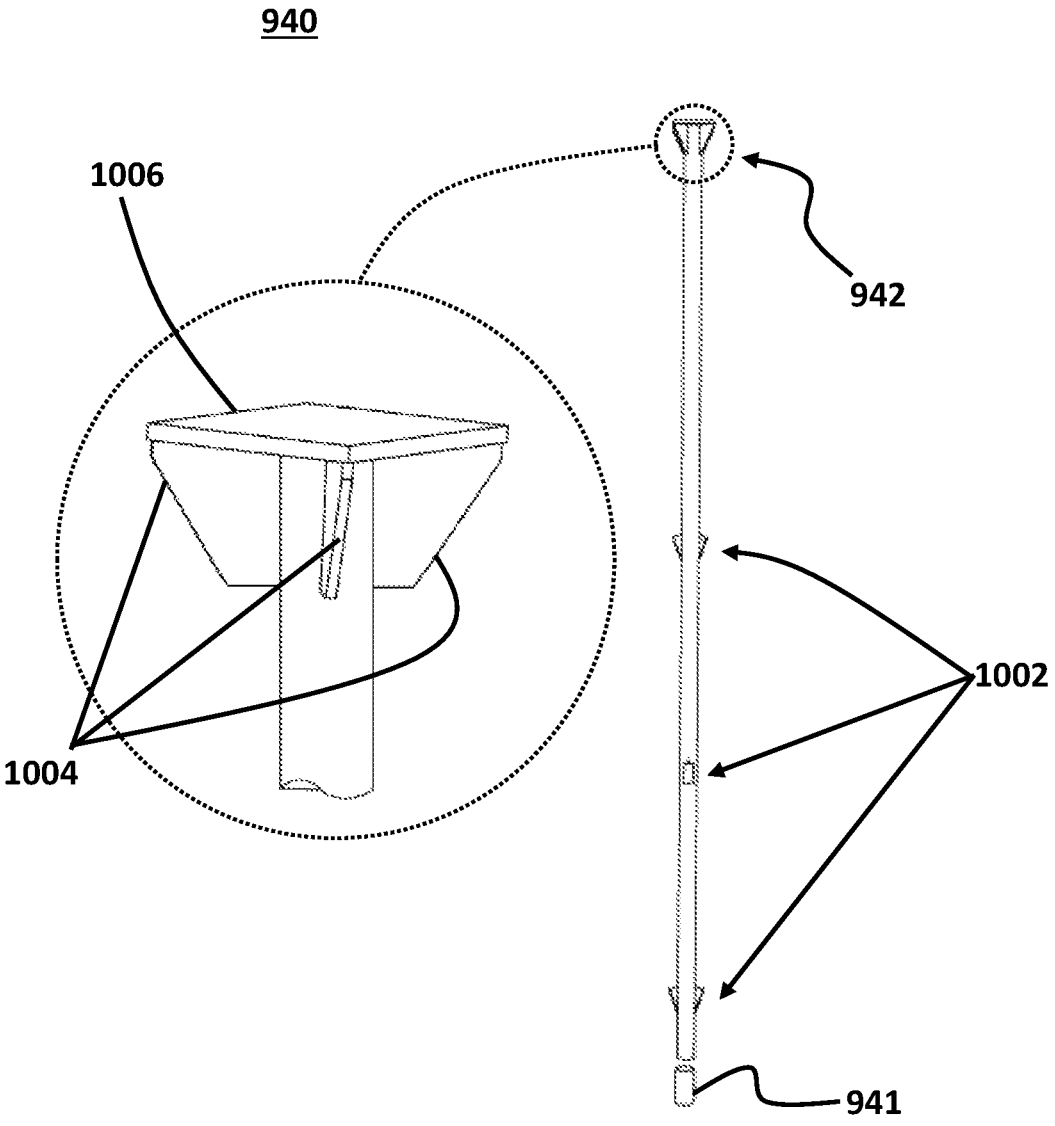
FIG. 10A illustrates a side view of a secondary pipe, consistent with one or more exemplary embodiments of the present disclosure.

FIG. 10A shows a side view of secondary pipe 940, consistent with one or more exemplary embodiments of the present disclosure. As shown in FIG. 10A, in an exemplary embodiment, secondary pipe 940 may include a second plurality of T-shaped elements 1002 attached around an outer surface of secondary pipe 940. In an exemplary embodiment, each T-shaped element from second plurality of T-shaped elements 1002 may be similar to first plurality of T-shaped elements in structure and functionality.

Figure 10B:
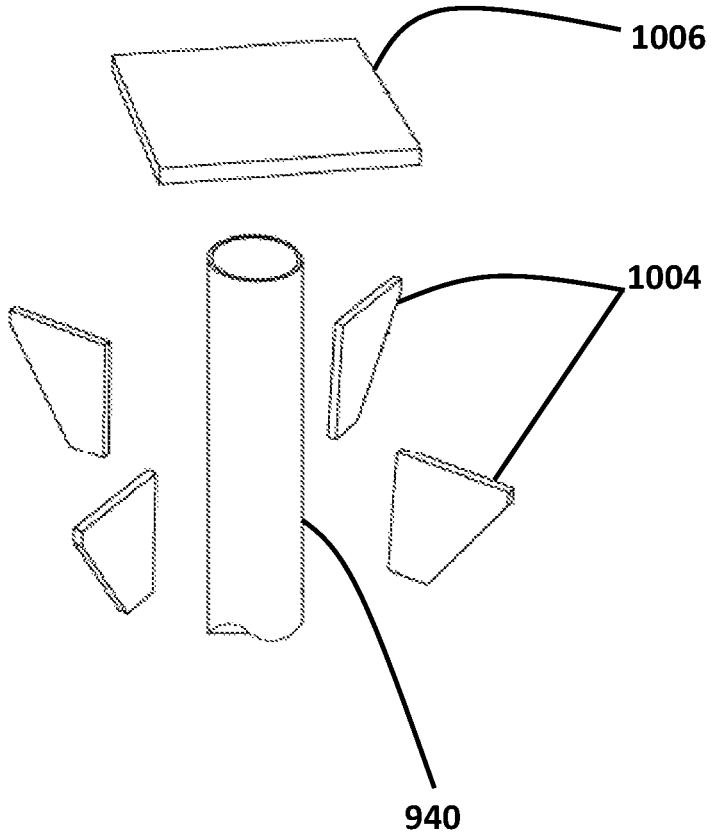
FIG. 10B illustrates an exploded view of a top end of a secondary pipe, consistent with one or more exemplary embodiments of the present disclosure.
Figure 10C:
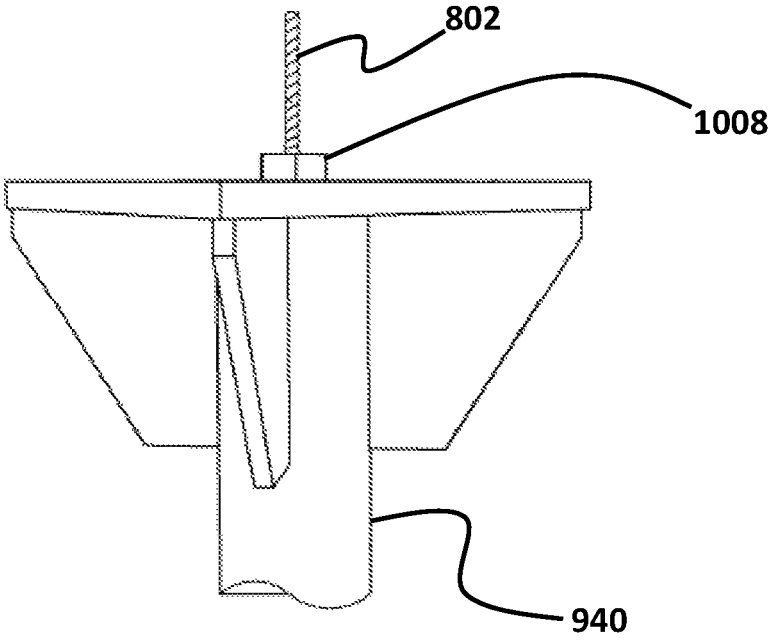
FIG. 10C illustrates a side view of a top end of a secondary pipe when a reinforcement bar is inserted into the secondary pipe and a barbed micropile, consistent with one or more exemplary embodiments of the present disclosure.
Figure 10D:
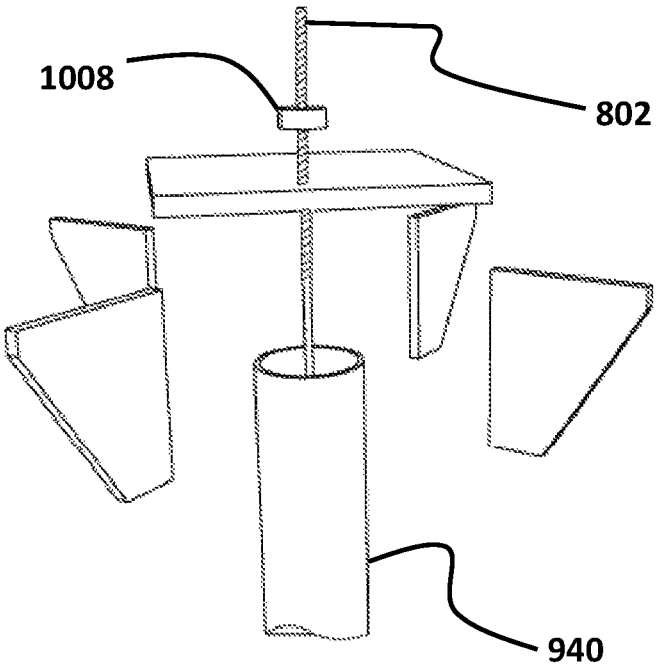
FIG. 10D illustrates an exploded view of a top end of a secondary pipe when a reinforcement bar is inserted into the secondary pipe and a barbed micropile, consistent with one or more exemplary embodiments of the present disclosure.
Figure 10E:
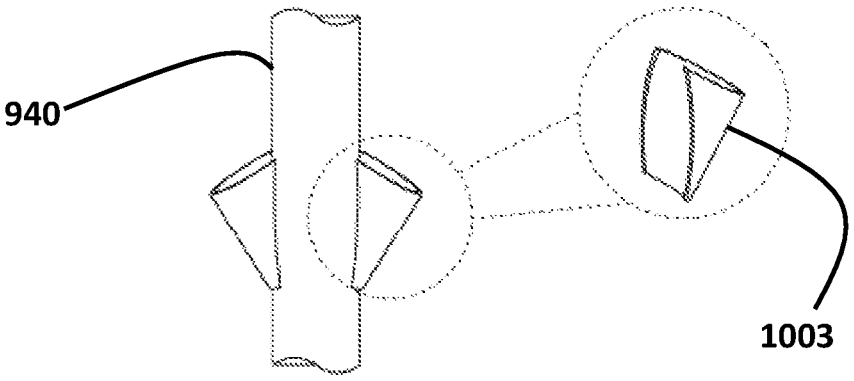
FIG. 10E illustrates a section of a secondary pipe, consistent with one or more exemplary embodiments of the present disclosure.

FIG. 10B shows an exploded view of a top end of secondary pipe 940, consistent with one or more exemplary embodiments of the present disclosure. As shown in FIG. 10A and FIG. 10B, in an exemplary embodiment, secondary pipe 940 may further include a plurality of vertical stiffeners 1004 attached to the outer surface of secondary pipe 940 at a top end 942 of secondary pipe 940. In an exemplary embodiment, secondary pipe 940 may further include a horizontal stiffener 1006 attached to top end 942 of secondary pipe 940. FIG. 10C shows a side view of top end 942 of secondary pipe 940 when reinforcement bar 802 is inserted into secondary pipe 940 and barbed micropile 100, consistent with one or more exemplary embodiments of the present disclosure. FIG. 10D shows an exploded view of top end 942 of secondary pipe 940 when reinforcement bar 802 is inserted into secondary pipe 940 and barbed micropile 100, consistent with one or more exemplary embodiments of the present disclosure. In an exemplary embodiment, a securing nut 1008 may be used to secure horizontal stiffener 1006 at its place. FIG. 10E shows a section of secondary pipe 940, consistent with one or more exemplary embodiments of the present disclosure. In an exemplary embodiment, secondary pipe 940 may include a hole which may be covered by a curved cap 1003. In an exemplary embodiment, the hole may be configured to allow grout flow from secondary pipe 940 toward an outside of secondary pipe 940. In an exemplary embodiment, curved cap 1003 may include a reduced pipe. In an exemplary embodiment, the reduced pipe may be obtained by cutting a pipe through an inclined plane relative to a main longitudinal axis of the pipe. In an exemplary embodiment, an angle between the inclined plane and the main longitudinal axis of the pipe may be 45°.

Figure 11A:
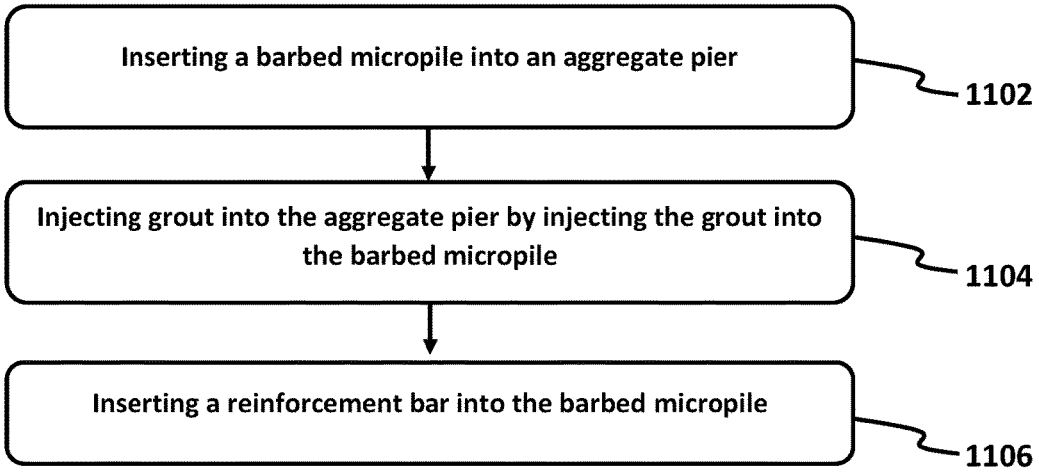
FIG. 11A is a method for reinforcing an aggregate pier, consistent with one or more exemplary embodiments of the present disclosure.
Figure 11B:
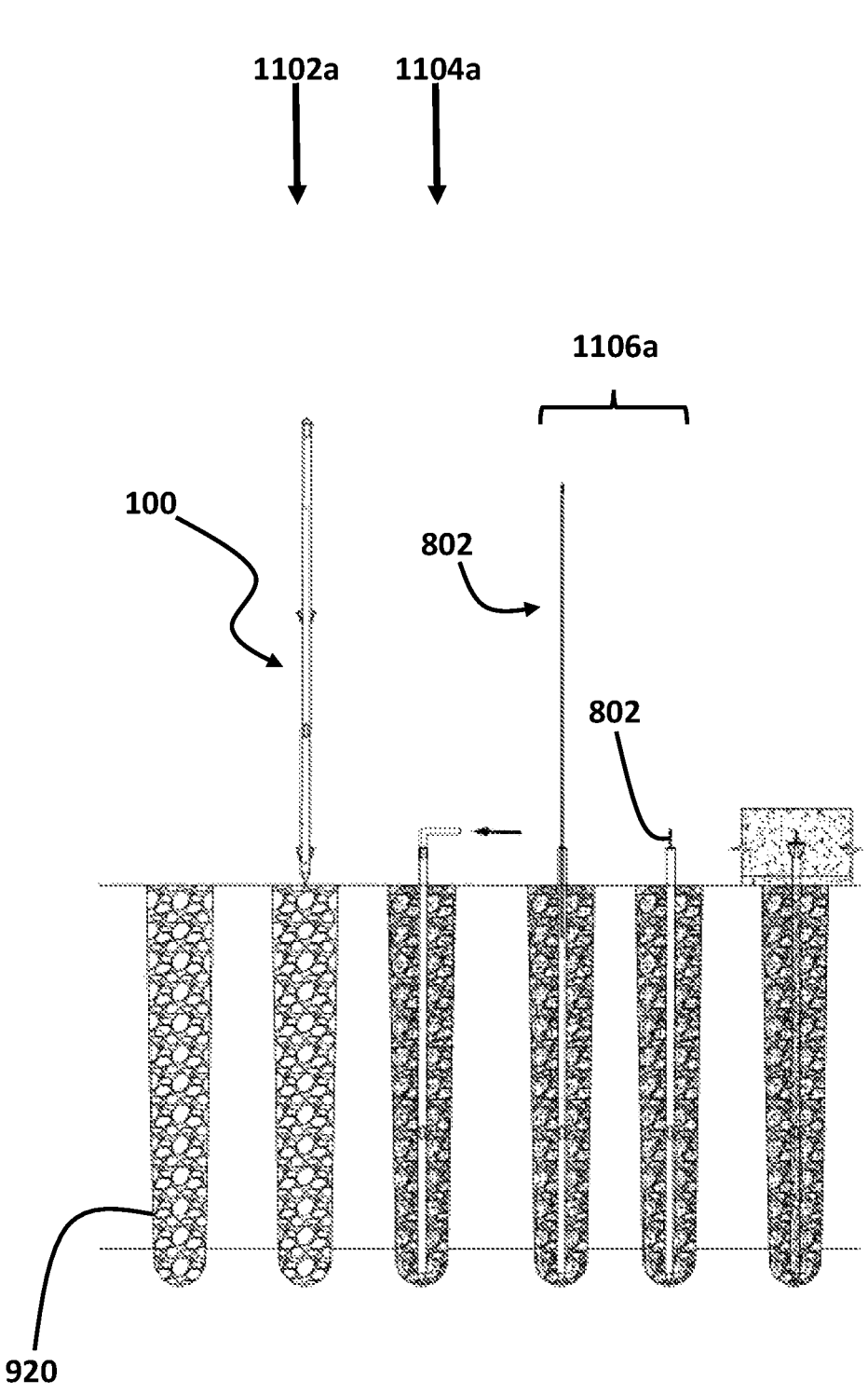
FIG. 11B illustrates a schematic implementation of a method for reinforcing an aggregate pier, consistent with one or more exemplary embodiments of the present disclosure.

FIG. 11A is method 1100 for reinforcing an aggregate pier, consistent with one or more exemplary embodiments of the present disclosure. FIG. 11B shows a schematic implementation of method 1100 for reinforcing an aggregate pier, consistent with one or more exemplary embodiments of the present disclosure. As shown in FIG. 11A, in an exemplary embodiment, method 1100 may include a step 1102 of inserting a barbed micropile into the aggregate pier, a step 1104 of injecting grout into the aggregate pier by injecting the grout into the barbed micropile, and a step 1106 of inserting a reinforcement bar into the barbed micropile. In an exemplary embodiment, step 1102*a* in FIG. 11B may correspond to step 1102 of method 1100 in FIG. 11A. In an exemplary embodiment, step 1104*a* in FIG. 11B may correspond to step 1104 of method 1100 in FIG. 11A. In an exemplary embodiment, step 1106*a* in FIG. 11B may correspond to step 1106 of method 1100 in FIG. 11A.

In an exemplary embodiment, with further details with regards to step 1102 of method 1100, inserting a barbed micropile into the aggregate pier may comprise, for example, inserting a barbed micropile such as barbed micropile 100, as shown in FIG. 1A, into an aggregate pier such as aggregate pier 920. In an exemplary embodiment, barbed micropile 100 may be inserted into aggregate pier 920 by utilizing a mechanical hammer such as mechanical hammer 710. In an exemplary embodiment, with further details with regards to step 1104 of method 1100, injecting grout into the aggregate pier by injecting the grout into the barbed micropile may comprise, for example, injecting grout into aggregate pier 920 by injecting the grout into barbed micropile 100. In an exemplary embodiment, injecting grout into barbed micropile 100 may continue until barbed micropile 100 is filled with grout and grout in aggregate pier 920 reaches a predetermined level. For example, grout may fill half of aggregate pier 920. In an exemplary embodiment, injecting grout into barbed micropile 100 may continue until barbed micropile 100 and aggregate pier 920 are filled with grout. In other words, injecting grout into barbed micropile 100 may continue until pore space inside aggregate pier 920 and inner chamber 1222 of hollow rod 122 are fully filled with grout.

In an exemplary embodiment, with further details with regards to step 1106 of method 1100, inserting a reinforcement bar into the barbed micropile may comprise, for example, inserting a reinforcement bar such as reinforcement bar 802 into secondary pipe 940 and barbed micropile 100. In an exemplary embodiment, reinforcement bar 802 may be inserted into barbed micropile 100 when the grout inside barbed micropile 100 is not dried yet.

Figure 12A:
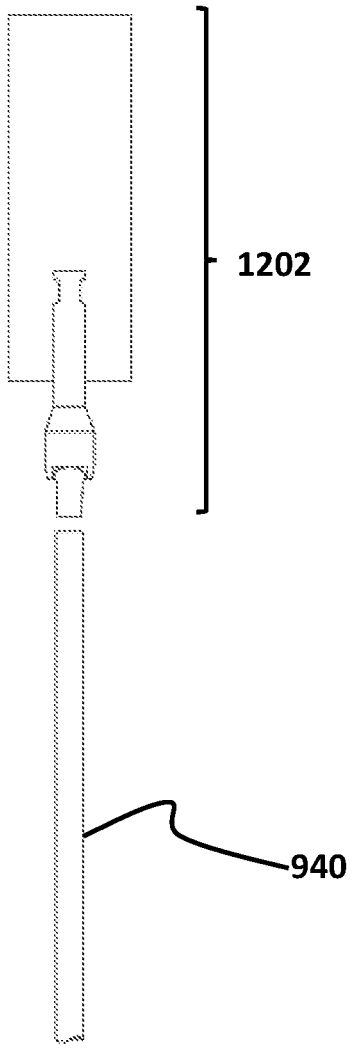
FIG. 12A illustrates a side view of a mechanical hammer and a secondary pipe, consistent with one or more exemplary embodiments of the present disclosure.
Figure 12B:
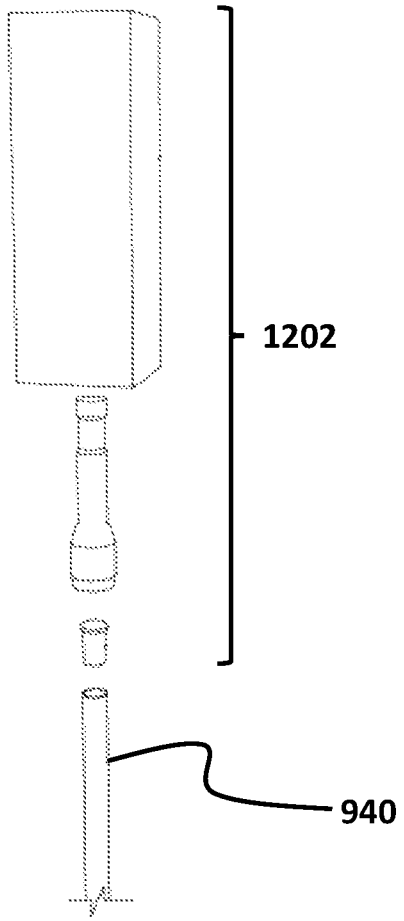
FIG. 12B illustrates an exploded view of a mechanical hammer and a secondary pipe, consistent with one or more exemplary embodiments of the present disclosure.

FIG. 12A shows a side view of a mechanical hammer 1202 and secondary pipe 940, consistent with one or more exemplary embodiments of the present disclosure. FIG. 12B shows an exploded view of mechanical hammer 1202 and secondary pipe 940, consistent with one or more exemplary embodiments of the present disclosure. As shown in FIG. 12A and FIG. 12B, in an exemplary embodiment, mechanical hammer 1202 may be utilized for driving secondary pipe 940 into aggregate pier 920.

While the foregoing has described what may be considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective spaces of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various implementations. This is for purposes of streamlining the disclosure, and is not to be interpreted as reflecting an intention that the claimed implementations require more features than are expressly recited in each claim. Rather, as the following claims reflect, inventive subject matter lies in less than all features of a single disclosed implementation. Thus, the following claims are hereby incorporated into the Detailed Description, with each claim standing on its own as a separately claimed subject matter.

While various implementations have been described, the description is intended to be exemplary, rather than limiting and it will be apparent to those of ordinary skill in the art that many more implementations and implementations are possible that are within the scope of the implementations. Although many possible combinations of features are shown in the accompanying figures and discussed in this detailed description, many other combinations of the disclosed features are possible. Any feature of any implementation may be used in combination with or substituted for any other feature or element in any other implementation unless specifically restricted. Therefore, it will be understood that any of the features shown and/or discussed in the present disclosure may be implemented together in any suitable combination. Accordingly, the implementations are not to be restricted except in light of the attached claims and their equivalents. Also, various modifications and changes may be made within the scope of the attached claims.

What is claimed is:

1. A method for reinforcing an aggregate pier, the method comprising:

inserting a conical-head pipe into the aggregate pier, the conical-head pipe comprising:

a hollow rod with an inner chamber and a thorough injection hole;

a conical head attached to a bottom end of the hollow rod; and a first plurality of T-shaped elements mounted around an outer surface of the hollow rod, each respective T-shaped element of the first plurality of T-shaped elements comprising:

a respective rectangular-shaped plate comprising a respective rectangular face;

a respective triangular-shaped plate comprising a first edge and a second edge, the triangular-shaped plate attached at the first edge of the triangular-shaped plate to the rectangular face of the rectangular-shaped plate, the triangular-shaped plate attached to the outer surface of the hollow rod at the second edge of the triangular-shaped plate;

injecting grout into the aggregate pier by injecting the grout into the inner chamber of the hollow rod;

driving the conical-head pipe into a soil under the aggregate pier by driving a secondary pipe into the aggregate pier and pushing the conical-head pipe toward the soil under the aggregate pier by utilizing the secondary pipe, the secondary pipe further comprising a second plurality of T-shaped elements attached around an outer surface of the secondary pipe, each respective T-shaped element of the second plurality of T-shaped elements comprising:

a respective rectangular-shaped plate comprising a respective rectangular face; and a respective triangular-shaped plate comprising a third edge and a fourth edge, the triangular-shaped plate attached at the third edge of the triangular-shaped plate to the rectangular face of the rectangular-shaped plate, the triangular-shaped plate attached to the outer surface of the hollow rod at the fourth edge of the triangular-shaped plate;

inserting a reinforcement bar into the secondary pipe and the hollow rod; and filling the secondary pipe with grout.

2. A method for reinforcing an aggregate pier, the method comprising:

inserting a conical-head pipe into the aggregate pier, the conical-head pipe comprising a hollow rod with an inner chamber and a thorough injection hole;

injecting grout into the aggregate pier by injecting the grout into the inner chamber of the hollow rod; and inserting a reinforcement bar into the hollow rod.

3. The method of claim 2, further comprising driving the conical-head pipe into a soil under the aggregate pier by driving a secondary pipe into the aggregate pier and pushing the conical-head pipe toward the soil under the aggregate pier by utilizing the secondary pipe.

4. The method of claim 3 further comprising filling the secondary pipe with grout.

5. The method of claim 4, wherein inserting the reinforcement bar into the hollow rod comprising inserting the reinforcement bar into the secondary pipe and the hollow rod.

6. The method of claim 5, wherein the conical-head pipe further comprises:

a conical head attached to a bottom end of the hollow rod; and a first plurality of T-shaped elements mounted around an outer surface of the hollow rod, each respective T-shaped element of the first plurality of T-shaped elements comprising:

a respective rectangular-shaped plate comprising a respective rectangular face; and a respective triangular-shaped plate comprising a first edge and a second edge, the triangular-shaped plate attached at the first edge of the triangular-shaped plate to the rectangular face of the rectangular-shaped plate, the triangular-shaped plate attached to the outer surface of the hollow rod at the second edge of the triangular-shaped plate.

7. The method of claim 6, wherein the first plurality of T-shaped elements comprises:

a first T-shaped element and a second T-shaped element in front of each other, the first T-shaped element and the second T-shaped element attached to opposite sides of the hollow rod;

a third T-shaped element and a fourth T-shaped element in front of each other, the first T-shaped element and the second T-shaped element attached to opposite sides of the hollow rod; and a fifth T-shaped element and a sixth T-shaped element in front of each other, the fifth T-shaped element and the sixth T-shaped element attached to opposite sides of the hollow rod.

8. The method of claim 7, wherein injecting the grout into the aggregate pier by injecting the grout into the inner chamber of the hollow rod comprising filling the aggregate pier and the inner chamber of the hollow rod by injecting the grout into the inner chamber of the hollow rod.

9. The method of claim 2, wherein the conical-head pipe further comprises:

a conical head attached to a bottom end of the hollow rod;

a first plurality of T-shaped elements mounted around an outer surface of the hollow rod, each respective T-shaped element of the first plurality of T-shaped elements comprising:

a respective rectangular-shaped plate comprising a respective rectangular face; and a respective triangular-shaped plate comprising a first edge and a second edge, the triangular-shaped plate attached at the first edge of the triangular-shaped plate to the rectangular face of the rectangular-shaped plate, the triangular-shaped plate attached to the outer surface of the hollow rod at the second edge of the triangular-shaped plate.

10. The method of claim 9, wherein the first plurality of T-shaped elements comprises:

a first T-shaped element and a second T-shaped element in front of each other, the first T-shaped element and the second T-shaped element attached to opposite sides of the hollow rod;

a third T-shaped element and a fourth T-shaped element in front of each other, the first T-shaped element and the second T-shaped element attached to opposite sides of the hollow rod; and a fifth T-shaped element and a sixth T-shaped element in front of each other, the fifth T-shaped element and the sixth T-shaped element attached to opposite sides of the hollow rod.

11. The method of claim 10, wherein the secondary pipe further comprises a second plurality of T-shaped elements attached around an outer surface of the secondary pipe, each respective T-shaped element of the second plurality of T-shaped elements comprising:

a respective rectangular-shaped plate comprising a respective rectangular face; and a respective triangular-shaped plate comprising a third edge and a fourth edge, the triangular-shaped plate attached at the third edge of the triangular-shaped plate to the rectangular face of the rectangular-shaped plate, the triangular-shaped plate attached to the outer surface of the hollow rod at the fourth edge of the triangular-shaped plate.

* * * * *